US006890402B2

(12) United States Patent
Gunji et al.

(10) Patent No.: US 6,890,402 B2
(45) Date of Patent: May 10, 2005

(54) SUBSTRATE HOLDING APPARATUS AND SUBSTRATE POLISHING APPARATUS

(75) Inventors: Yoshihiro Gunji, Ibaraki-ken (JP); Hozumi Yasuda, Kanagawa-ken (JP); Keisuke Namiki, Kanagawa-ken (JP); Hiroshi Yoshida, Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 370 days.

(21) Appl. No.: 09/917,732

(22) Filed: Jul. 31, 2001

(65) Prior Publication Data

US 2002/0017365 A1 Feb. 14, 2002

(30) Foreign Application Priority Data

Jul. 31, 2000 (JP) ..... 2000/231892
Sep. 14, 2000 (JP) ..... 2000/280216

(51) Int. Cl.[7] ..... B24B 37/04; B24B 41/06
(52) U.S. Cl. ..... 156/345.14; 451/9
(58) Field of Search ..... 156/345.14, 345.21, 156/345.12, 345.17, 345.18; 451/9

(56) References Cited

U.S. PATENT DOCUMENTS 5,695,392 A 12/1997 Kim
5,851,140 A 12/1998 Barns et al.
5,941,758 A 8/1999 Mack
5,967,885 A 10/1999 Crevasse et al.
6,019,671 A 2/2000 Shendon
6,056,632 A 5/2000 Mitchel et al.
6,093,082 A 7/2000 Somekh
6,146,259 A 11/2000 Zuniga et al.
6,432,258 B1 * 8/2002 Kimura et al. ..... 156/345.14
6,595,831 B1 * 7/2003 Hirokawa et al. ..... 451/36

FOREIGN PATENT DOCUMENTS

EP 0870576 A2 10/1998
WO 00/21715 4/2000
WO 00/26609 5/2000

* cited by examiner

*Primary Examiner*—Gregory Mills
*Assistant Examiner*—Sylvia R. MacArthur
(74) *Attorney, Agent, or Firm*—Wenderoth, Lind & Ponack, L.L.P.

(57) ABSTRACT

A substrate holding apparatus comprises a substrate holder body having a substrate holding side facing a polishing surface and holding a substrate on the substrate holding side and a retainer ring fixedly secured to the substrate holder body. The retainer ring is arranged to surround an outer periphery of the substrate held by the substrate holder body so that the retainer ring engages with the polishing surface radially outside the substrate as the polishing of the substrate is effected. The substrate holder body is provided with a membrane having inside and outside surfaces. The inside surface cooperates with a surface of the substrate holder body to define a fluid pressure chamber to which a fluid pressure is applied. The outer surface engages with the substrate held by the substrate holder body.

29 Claims, 13 Drawing Sheets

SUBSTRATE HOLDING APPARATUS AND SUBSTRATE POLISHING APPARATUS

BACKGROUND OF THE INVENTION

The present invention relates to a substrate holding apparatus in which a substrate is held when polished for flattening a surface thereof. The present invention also relates to a polishing apparatus comprising the above-mentioned substrate holding apparatus.

A semiconductor device fabricating process comprises forming a thin film layer on a wafer and forming minute patterns and holes in the layer. This process is repeated until a desired number of circuit layers are formed on the wafer. Therefore, raised and recessed portions are created on or added to the surface of the wafer after formation of each circuit layer. In recent years, semiconductor devices have become increasingly minute and element structures of semiconductor devices have become complicated. Further, there is a tendency to increase the number of circuit layers for logic type devices. As a result, raised and recessed portions on the surface of a semiconductor device increase in number and a difference in height between these portions also increases. This leads to a problem such that during formation of a film on the wafer, an extremely thin film is formed over an undulating area containing the raised and recessed portions on the wafer and breaks in a circuit and an electrical insulation defect between circuit layers are likely to occur, leading to a lowering of product quality and a lowering of yield. Although semiconductor devices can operate normally during an initial period of operation, they are not reliable when used over a long period of time.

Raised and recessed portions on the wafer are also problematic in a lithography process. That is, when an exposure surface of the wafer contains raised and recessed portions, the lenses of an exposure system partially become out of focus, so that formation of minute patterns becomes difficult.

For these reasons, the techniques for surface flattening in fabricating semiconductor devices have been increasingly becoming important. Of various surface flattening techniques, the most important technique is CMP (chemical mechanical polishing), which comprises polishing by using a polishing apparatus, in which while an abrasive liquid containing abrasive particles of silica ($SiO_2$) or the like is supplied onto a polishing surface of a polishing pad, a semiconductor wafer is slidably engaged with the polishing surface.

Conventionally, the polishing apparatus of the above-mentioned type comprises a polishing table including a polishing pad having a polishing surface and a wafer holder for holding a semiconductor wafer. The wafer holder is adapted to hold a semiconductor wafer and press the wafer against the polishing table under a predetermined pressure. The wafer holder and the polishing table are moved relative to each other so that the semiconductor wafer is slidably engaged with the polishing surface, to thereby polish the wafer to a flat and mirror-finished surface.

In the above-mentioned polishing apparatus, when a relative pressure generated between the semiconductor wafer and the polishing surface of the polishing pad is not uniform over an entire surface of the wafer, insufficient or excessive polishing is likely to occur, depending on the pressure acting on each part of the wafer. Therefore, in order to apply a uniform pressure to an entire surface of the wafer, an elastic membrane made of rubber is provided on the wafer holder on a surface thereof for holding a wafer, and a fluid pressure such as air pressure is applied to a back surface of the elastic membrane. In this case, a circumferential edge of the wafer surface corresponds to a boundary between a contact portion and a non-contact portion of the wafer relative to the polishing surface. Since the polishing pad is elastic, the pressure applied to a portion around the circumferential edge of the wafer surface becomes non-uniform, so that only the circumferential edge of the wafer is polished in an excessive amount, and the wafer is caused to have a "dull" edge.

As a countermeasure, it has been proposed to use a wafer holder in which a guide ring or retainer ring for holding an outer circumferential edge of the wafer presses the polishing surface at a position outside the wafer. In this wafer holder, the retainer ring is pressed against the polishing surface under fluid pressure such as air pressure.

FIG. 14 is a schematic illustration of a wafer holder of the above-mentioned type, in which a fluid pressure is applied to a wafer so as to press the wafer against a polishing surface, and the fluid pressure is also applied to a retainer ring so as to press the retainer ring against the polishing surface.

As shown in FIG. 14, a wafer holder 50 comprises: a wafer holder body 51 defining an inner space; a wafer pressurizing mechanism 52 contained in the inner space of the wafer holder body 51 and adapted to press a semiconductor wafer W against a polishing surface 61 of a polishing table 60; a retainer ring 53 provided so that it is vertically movable relative to the wafer holder body 51 and adapted to hold an outer circumferential edge of the wafer W; and a retainer ring pressurizing mechanism 54 for pressing the retainer ring 53 against the polishing surface 61.

The wafer pressurizing mechanism 52, although not shown in detail, comprises an elastic membrane member which is made of an elastic material such as rubber and is connected to the wafer holder body 51. A pressurized fluid such as pressurized air is supplied to the inside of the elastic membrane member so that the wafer W is pressed against the polishing surface 61 under fluid pressure. The retainer ring pressurizing mechanism 54, although not shown in detail, also comprises an elastic membrane member which is made of an elastic material such as rubber and is connected to the wafer holder body 51. A pressurized fluid such as pressurized air is supplied to the inside of the elastic membrane member so that the retainer ring 53 is pressed against the polishing surface 61 under fluid pressure. The wafer holder body 51 is connected to a drive shaft 55 and the drive shaft 55 is adapted to be vertically moved by a lifting mechanism such as an air cylinder.

The lifting mechanism such as an air cylinder connected to the drive shaft 55 is operated so as to move the wafer holder body 51 as a whole to a position close to the polishing table 60. While the wafer W is held in proximity to the polishing surface 61, the pressurized fluid is supplied under a predetermined pressure to the wafer pressurizing mechanism 52, to thereby press the wafer W against the polishing surface 61 of the polishing table 60. The pressure applied to the wafer W during polishing is adjusted to a desired value by adjusting the pressure of the pressurized fluid supplied to the wafer pressurizing mechanism 52. On the other hand, the pressurized fluid is supplied under a predetermined pressure to the retainer ring pressurizing mechanism 54, to thereby press the retainer ring 53 against the polishing surface 61 of the polishing table 60.

Since the wafer W is pressed against the polishing surface 61 by using a fluid pressure, it is possible to obtain a uniform pressure distribution across an entire surface of the wafer W from the center to the circumferential edge thereof. This enables uniform polishing of the entire surface of the wafer W. Further, during polishing, a pressure substantially equal to that applied to the wafer W is applied to the retainer ring 53 through the retainer ring pressurizing mechanism 54, so that the polishing surface of the polishing pad outside the wafer W is pressed under a pressure substantially equal to that of the wafer W. Therefore, a uniform pressure distribution can be obtained continuously across an area from the center of the wafer W to an outer circumferential portion of the retainer ring 53 outside the wafer W. Therefore, excessive or insufficient polishing at the circumferential edge of the wafer W can be prevented.

In the above-mentioned conventional wafer holder in which both the wafer and the retainer ring are pressed under fluid pressure, the retainer ring is capable of moving in either a vertical (or perpendicular) direction or a lateral (or radial) direction relative to the wafer holder body. That is, the retainer ring is capable of moving independently of the wafer holder body. Movement of the retainer ring affects uniformity in the polishing of an outer circumferential portion of the wafer surface. Although vertical movement of the retainer ring is necessary for polishing, lateral movement of the retainer ring is unnecessary. Rather, lateral movement of the retainer ring is undesirable because it varies the distance between the retainer ring and the circumferential edge of the wafer surface and impairs uniformity and stability in the polishing of the outer circumferential portion of the wafer surface.

Further, in the conventional wafer holder, since the surface of the wafer holder for holding a wafer is covered with the elastic membrane, it is required to form, for example, a suction cup-like configuration in the elastic membrane so as to hold a wafer during transfer thereof. When a wafer is held by the elastic membrane having a suction cup-like configuration, warpage or deformation of the wafer occurs. Due to warpage of the wafer, the wafer can be broken during transfer thereof or a device structure formed on the wafer can be damaged. Further, since the wafer is held by indirect contact with the wafer holder through the elastic membrane, defects in holding of the wafer are likely to occur during transfer of the wafer, leading to a lowering of operating rate of the wafer holder and a lowering of yield of wafers.

Further, in chemical mechanical polishing (CMP) utilizing an elastic polishing pad and an abrasive liquid (slurry), the following problem arises. That is, when a wafer surface having raised and recessed portions is polished, the raised portions are polished in preference to the recessed portions during an initial period of polishing, but after the raised portions are polished by a certain amount, the recessed portions are also gradually subjected to polishing (as well as the raised portions). Therefore, the difference in height between the raised portions and the recessed portions cannot be easily reduced. That is, because polishing is conducted by using a relatively soft, elastic polishing pad and a slurry type abrasive liquid containing a large amount of free abrasive particles, chemical mechanical polishing is effected on not only the raised portions, but also the recessed portions of the wafer surface. Further, the effect of polishing varies, depending on the density of raised and recessed portions.

Therefore, an attempt has been made with respect to polishing by using a polishing surface comprising fixed abrasive particles such as cerium oxide ($CeO_2$), which are bound by using a binder such as a phenol resin. In this polishing, the polishing surface is hard as compared to the polishing pad conventionally used in chemical mechanical polishing, so that the raised portions are polished in preference to the recessed portions and the recessed portions are unlikely to be polished. Therefore, absolute flatness of the wafer can be easily obtained.

However, a wafer holder suitable for a hard polishing surface comprising fixed abrasive particles has not been developed. Generally, a conventional wafer holder for the hard polishing surface comprises a rigid wafer holder body and an elastic backing pad provided on the rigid wafer holder body adapted to be engaged with a wafer to be held by the wafer holder. Although the elastic backing pad can absorb shocks on the wafer, it is difficult for the elastic backing pad to take care of undulations on the hard polishing surface, whereby the undulations are transferred to and affects the wafer surface to be polished.

SUMMARY OF THE INVENTION

In view of the above, the present invention has been made.

In accordance with the present invention, there is provided a substrate holding apparatus for holding a substrate and bringing it into contact with a polishing surface so that the substrate is subjected to polishing by causing relative movement between the substrate and the polishing surface, the apparatus comprising a substrate holder body having a substrate holding side facing the polishing surface and holding a substrate on the substrate holding side and a retainer ring integrally formed with or fixedly secured to the substrate holder body on the substrate holding side, the retainer ring being arranged to surround an outer periphery of the substrate held by the substrate holder body so that the retainer ring engages with the polishing surface radially outside the substrate as the polishing of the substrate is effected. The substrate holder body is provided on the substrate holding side with a membrane having opposite surfaces including inside and outside surfaces, the inside surface cooperating with a surface of the substrate holder body to define a fluid pressure chamber to which a fluid pressure is applied, the outer surface engaging with the substrate held by the substrate holder body.

In accordance with another aspect of the present invention, there is provided a substrate holding apparatus in which, instead of the membrane which covers the entire surface of the substrate, the apparatus comprises a substrate support ring provided in the inner space and arranged to be sealingly engaged with the substrate to be held by the substrate holding apparatus, and a flexible seal member sealingly connected between the substrate support ring and the substrate holder body so that a fluid pressure chamber is defined by the substrate holder body, the flexible seal member and the substrate engaged with the substrate support ring. The fluid pressure chamber is arranged to be selectively connected to a pressurized fluid source or a vacuum source.

These substrate holding apparatuses eliminate a relative movement between the retainer ring and the wafer holder body whereby the behavior of the retainer ring can be stabilized during polishing. A substrate is held on the fluid pressure chamber so that the substrate can follow undulations on a polishing surface.

In accordance with a further aspect of the present invention, there is provided a polishing apparatus including a substrate holding apparatus as stated above.

Further, in accordance with another aspect of the present invention, there is provided a substrate polishing apparatus comprising a first polishing table having a hard polishing surface and a substrate holding apparatus for holding a substrate and bringing it into contact with the hard polishing surface. The substrate holding apparatus comprises a substrate holder body having a substrate holding side facing the polishing surface and holding a substrate on the substrate holding side and a membrane provided on the substrate holding side of the substrate holder body, the membrane having opposite surfaces including inside and outside surfaces, the inside surface cooperating with a surface of the substrate holder body to define a fluid pressure chamber to which a fluid pressure is applied, the outer surface engaging with the substrate held by the substrate holder body. The hard polishing surface has, for example, a modulus of compression of 19.6 MPa (200 kg/cm$^2$) or more. In this apparatus, a substrate is held on the fluid pressure chamber which is supplied with a fluid pressure to press the substrate against the polishing surface so that the substrate can follow undulations on a polishing surface during its polishing operation.

The substrate polishing apparatus may further include a second polishing table having a soft polishing surface which is softer (or of smaller elastic module) than the hard polishing of the first polishing table. The substrate holder body is arranged such that the substrate holder body holds a substrate and, then, bring the substrate into contact with the hard polishing surface to effect a first polishing of the substrate and, thereafter, bring the substrate into contact with the soft polishing surface to effect a second polishing of the substrate. By this apparatus, a highly flattened wafer surface having fewer scratch marks can be obtained.

This polishing apparatus may be modified as follows. In stead of the membrane which covers the entire surface of the substrate, the apparatus comprises a substrate support ring provided in the inner space and arranged to be sealingly engaged with the substrate to be held by the substrate holding apparatus, and a flexible seal member sealingly connected between the substrate support ring and the substrate holder body so that a fluid pressure chamber is defined by the substrate holder body, the flexible seal member and the substrate engaged with the substrate support ring. The fluid pressure chamber is arranged to be selectively connected to a pressurized fluid source or a vacuum source.

The foregoing and other objects, features and advantages of the present invention will be apparent from the following detailed description and appended claims taken in connection with the accompanying drawings.

DETAILED DESCRIPTION OF THE INVENTION

Hereinbelow, description is made with regard to embodiments of the present invention, with reference to FIGS. 1 to 13.

Figure 1:
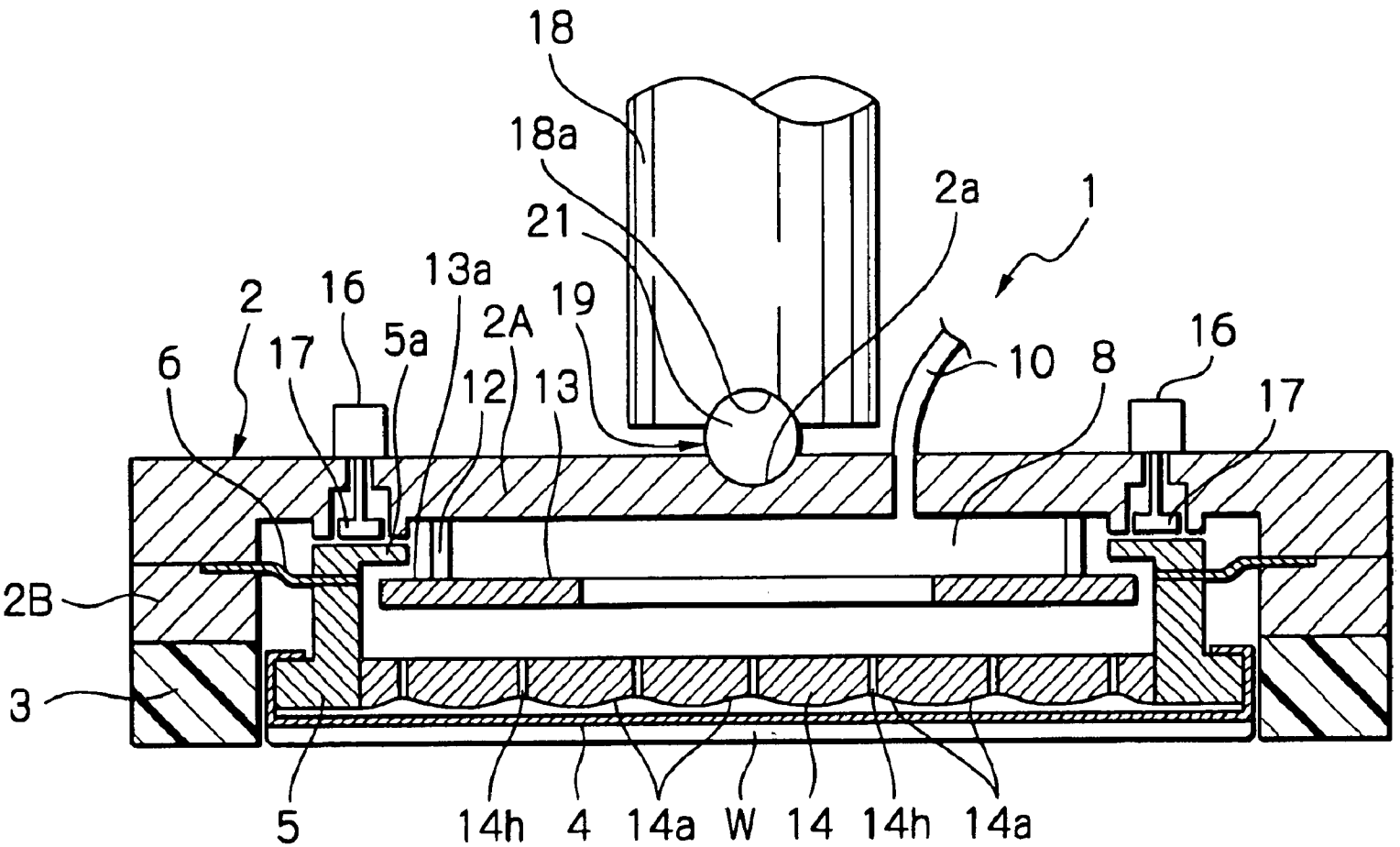
FIG. 1 is a longitudinal sectional view of a substrate holding apparatus according to a first embodiment of the present invention.
Figure 2:
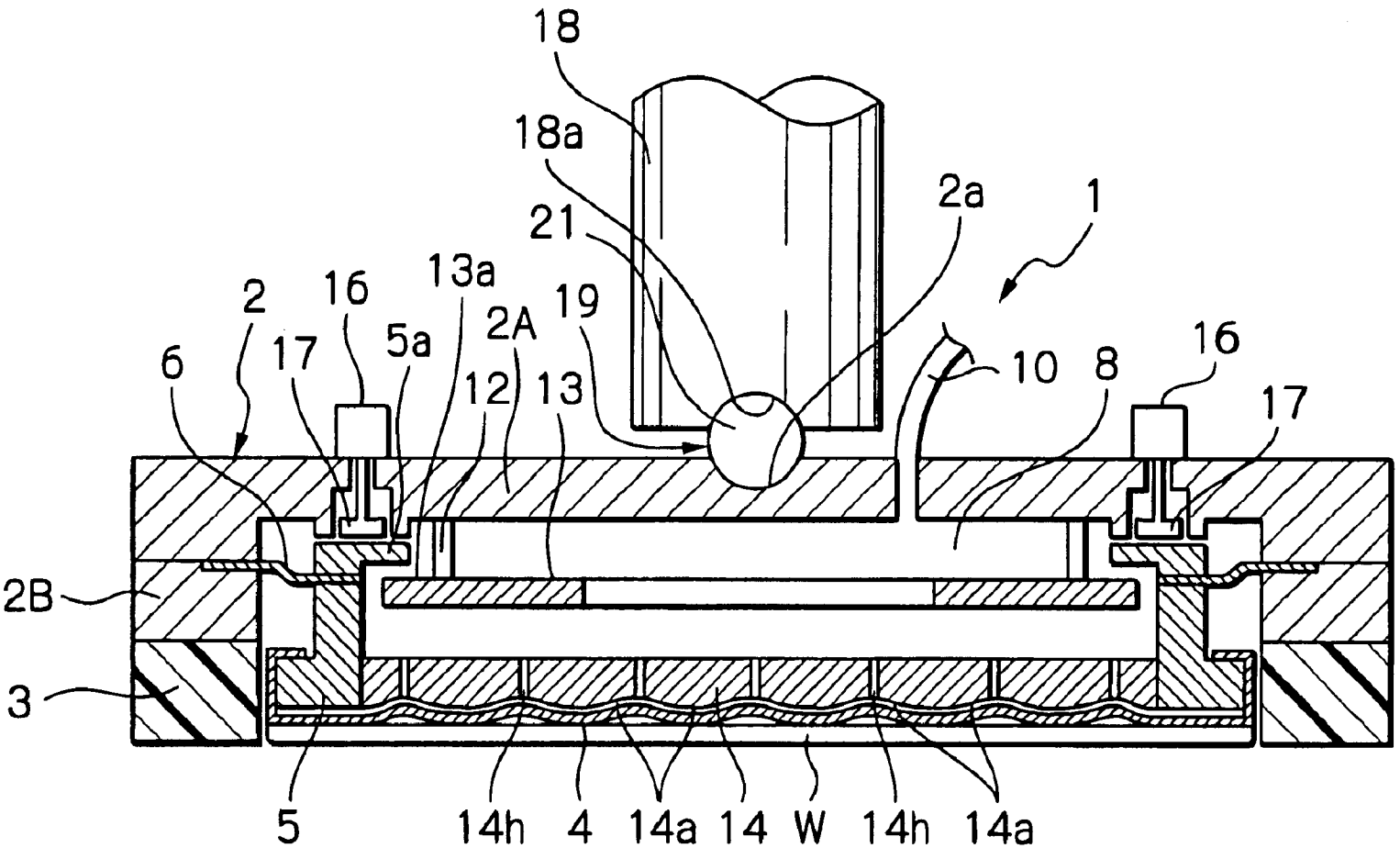
FIG. 2 is a longitudinal sectional view showing how the substrate holding apparatus of FIG. 1 is operated.

FIG. 1 is a longitudinal sectional view of a substrate holding apparatus 1 according to a first embodiment of the present invention. FIG. 2 is a longitudinal sectional view showing how the substrate holding apparatus of FIG. 1 is operated.

The substrate holding apparatus 1 is adapted to hold a substrate or, in this embodiment, a semiconductor wafer W to be polished and press the wafer against a polishing surface of a polishing table. As shown in FIG. 1, the substrate holding apparatus comprises a dish-like wafer holder body 2 defining an inner space and a retainer ring 3 fixed to the wafer holder body 2. The wafer holder body 2 is made of a material having high strength and high rigidity, such as a metal and a ceramic, and comprises a circular upper plate 2A and a circumferential wall portion 2B extending downward from the upper plate 2A. The retainer ring 3 is fixed to a lower end of the circumferential wall portion 2B. The retainer ring 3 is made of a resin material having high rigidity. It should be noted that the retainer ring 3 may be formed integrally with the wafer holder body 2.

The wafer holder body 2 and the retainer ring 3 define an inner space for containing an elastic membrane 4 and an elastic membrane supporting member 5 in a generally cylindrical form. The elastic membrane supporting member 5 holds an outer circumferential portion of the elastic membrane 4. A flexible sheet 6 made of an elastic membrane extends between the elastic membrane supporting member 5 and the wafer holder body 2. A fluid chamber 8 having a sealable structure is formed by the wafer holder body 2, the elastic membrane 4, the flexible sheet 6 and an inner surface of the wafer holder body. Each of the elastic membrane 4 and the flexible sheet 6 is formed from a rubber material which is excellent in strength and durability, such as an ethylene propylene rubber (EPDM), a polyurethane rubber or a silicone rubber. A pressurized fluid such as pressurized air is supplied to the fluid chamber 8 through a fluid passage 10 comprising a tube and a connector. The pressure of pressurized fluid supplied to the fluid chamber 8 can be varied by means of a regulator. A slight gap is formed between an outer circumferential surface of the elastic membrane 4, and the wafer holder body 2 and the retainer ring 3. The elastic membrane 4 and the elastic membrane supporting member 5 are vertically movable relative to the wafer holder body 2 and the retainer ring 3.

For insuring high polishing performance, it is preferred to form the fluid chamber 8 by using an elastic membrane as in this embodiment. However, the elastic membrane 4 may not be used and the wafer may be pressed by direct contact with the fluid. When the elastic membrane 4 is not used, the fluid chamber is formed by the wafer holder body 2 and the rear surface of the wafer to be polished.

An annular stopper plate 13 is fixed through a support member 12 to the upper plate 2A of the wafer holder body 2. An upper end surface 13*a* of the stopper plate 13 is positioned at a predetermined height and the stopper plate 13 provides a restricting member. When the pressurized fluid is supplied to the fluid chamber 8, the elastic membrane 4 and the elastic membrane supporting member 5 move as a unit downward relative to the wafer holder body 2. In this instance, an upper end portion 5*a* of the elastic membrane supporting member 5 engages the upper end surface 13*a* of the stopper plate 13, thus limiting the downward movement of the elastic membrane 4 and the elastic membrane supporting member 5 to a predetermined range.

A chucking plate 14 including a plurality of through-holes 14*h* is provided inside the elastic membrane supporting member 5. In this embodiment, the chucking plate 14 is fixed to an inner side of the elastic membrane supporting member 5. However, the chucking plate 14 may be formed integrally with the elastic membrane supporting member 5. A number of spherical recesses 14*a* are formed on a lower surface of the chucking plate 14. As shown in FIG. 2, when a negative pressure is applied to the fluid chamber 8 through the fluid passage 10 from a vacuum source, the elastic membrane 4 is deformed along the spherical recesses 14*a* of the chucking plate 14. That is, the portions of the elastic membrane 4 corresponding to the spherical recesses 14*a* of the chucking plate 14 form suction cups and hold the wafer W on a lower surface of the elastic membrane 4.

A plurality of stoppers 17 operated by actuators 16 such as air cylinders is provided in the upper plate 2A of the wafer holder body 2. By operating the actuators 16, the stoppers 17 are protruded downward by a predetermined length as shown in FIG. 2. When a negative pressure is applied to the fluid chamber 8, the elastic membrane supporting member 5 moves upward together with the elastic membrane 4 and the upper end portion 5*a* of the elastic membrane supporting member 5 abuts against the stoppers 17, thus limiting the upward movement of the elastic membrane supporting member 5 and the elastic membrane 4 to a predetermined range. That is, the stoppers 17 provide restricting members having an adjustable heightwise position. When the actuator 16 is arranged so as to have a mechanism such as an air cylinder capable of generating a variable pressure and the stoppers 17 are protruded during polishing so as to press the elastic membrane supporting member 5 in a downward direction, an outer circumferential portion of the wafer W can be mechanically pressed against the polishing surface. A wafer holder drive shaft 18 is provided above the upper plate 2A of the wafer holder body 2. The drive shaft 18 and the wafer holder body 2 are connected through a universal joint 19.

The universal joint 19 transmits pressure and torque of the drive shaft 18 to the wafer holder body 2 while permitting inclination of the drive shaft 18 and the wafer holder body 2 relative to each other. The universal joint 19 comprises a spherical bearing mechanism which permits inclination of the wafer holder body 2 and the drive shaft 18 relative to each other and a torque transmitting mechanism which transmits rotation of the drive shaft 18 to the wafer holder body 2. The spherical bearing mechanism comprises a spherical recess 18*a* formed at a central portion of a lower surface of the drive shaft 18, a spherical recess 2*a* formed at a central portion of an upper surface of the upper plate 2A and a bearing ball 21 made of a material having high hardness, such as a ceramic, provided between the spherical recess 18*a* and the spherical recess 2*a*.

The torque transmitting mechanism comprises a drive pin (not shown) fixed to the drive shaft 18 and a driven pin (not shown) fixed to the upper plate 2A. The two pins are capable of moving vertically relative to each other and engaging at different contact positions. Therefore, a torque of the drive shaft 18 is surely transmitted to the wafer holder body 2 even when the wafer holder body 2 is inclined.

Next, explanation is made with regard to operation of the wafer holder 1 arranged as mentioned above.

The wafer holder 1 as a whole is moved to a position for transferring a wafer and the fluid chamber 8 is connected to the vacuum source through the fluid passage 10. Consequently, as shown in FIG. 2, the elastic membrane 4 is deformed and holds the wafer W on the lower surface thereof due to the effect of suction cups formed along the recesses 14*a* of the chucking plate 14. While holding the wafer W on the elastic membrane 4, the wafer holder 1 as a whole is moved to a position above a polishing table (designated by reference numeral 30 in FIG. 8) having a polishing surface (such as a polishing pad). The wafer W and the retainer ring 3 are then pressed against the polishing surface to thereby start polishing. An outer circumferential edge of the wafer W is held by the retainer ring 3 so that the wafer W is not separated from the wafer holder 1.

For polishing the wafer W, an air cylinder (designated by reference numeral 33 in FIG. 8) connected to the drive shaft 18 is operated to thereby press the retainer ring 3 fixed to the wafer holder body 2 against the polishing surface of the polishing table under a predetermined pressure. In this state, the pressurized fluid is supplied under a predetermined pressure to the fluid chamber 8 to thereby press the wafer W against the polishing surface of the polishing table. The pressure applied to the wafer W for polishing is adjusted to a desired level by controlling the pressure of pressurized fluid supplied to the fluid chamber 8. Thus, the pressure of fluid in the fluid chamber 8 is applied to the wafer W, so that it is possible to obtain a uniform pressure distribution for polishing across an entire surface of the wafer W from the center to the circumferential edge thereof, regardless of the thickness of the wafer W. This enables uniform polishing of the entire surface of the wafer W.

During polishing, pressure substantially equal to or slightly higher than that applied to the wafer W is applied to the retainer ring 3 through the air cylinder, so that the polishing surface outside the wafer W is pressed under a pressure substantially equal to that of the wafer W. Therefore, a uniform pressure distribution can be obtained continuously across an area from the center of the wafer W to an outer circumferential portion of the retainer ring 3 outside the wafer W. Therefore, excessive or insufficient polishing at the circumferential edge of the wafer W can be prevented.

Figure 3:
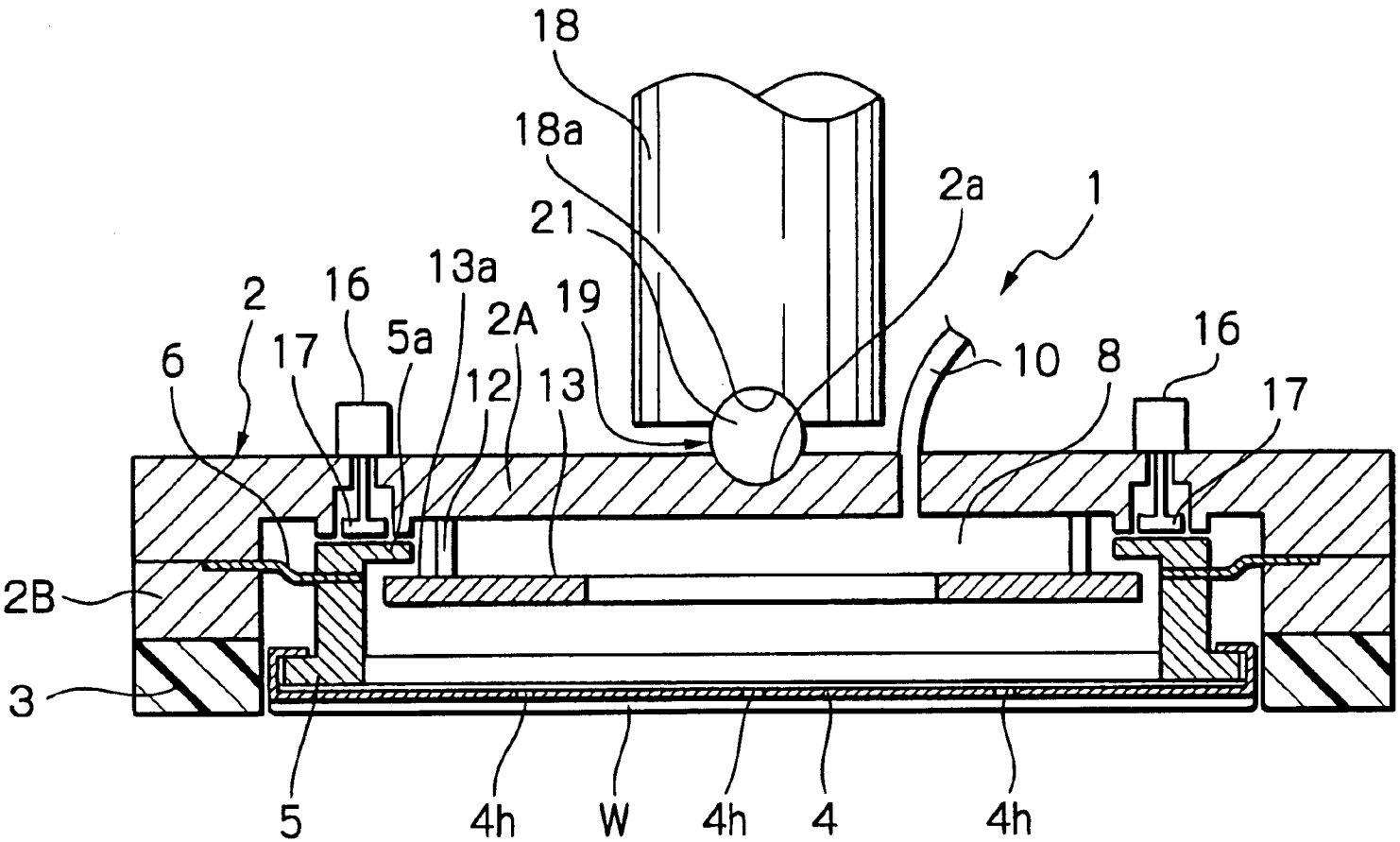
FIG. 3 is a longitudinal sectional view of a substrate holding apparatus according to a second embodiment of the present invention.

FIG. 3 is a vertical cross-sectional view of a substrate holding apparatus according to a second embodiment of the present invention. In this embodiment, the chucking plate 14 is not provided and a space inside the elastic membrane supporting member 5 is empty. Instead of providing the chucking plate 14, a plurality of through-holes 4*h* is formed in the elastic membrane 4 in an area between the center and an outer circumferential portion thereof. Therefore, when a negative pressure is applied from the vacuum source through the fluid passage 10 to the fluid chamber 8 for holding the wafer W on the lower surface of the elastic membrane 4, the wafer W is held due to the effect of vacuum force directly applied through the through-holes 4*h*.

In the wafer holder 1 in this embodiment, during polishing, as is in the first embodiment, a pressurized fluid is supplied to the fluid chamber 8 so that a wafer W is pressed against a polishing surface by the elastic membrane 4 with the through-holes 4*h* in the membrane 4 being closed by the wafer W.

In the embodiments shown in FIGS. 1 to 3, the retainer ring 3 is fixedly connected to the wafer holder body 2 having a rigid construction and the retainer ring 3 is vertically moved by vertically moving the wafer holder body 2. By this arrangement, the pressure applied to the wafer holder body 2 can be utilized as a pressure for pressing the retainer ring 3. Further, because the retainer ring 3 is fixed to the wafer holder body 2, undesirable lateral (or radial) movement of the retainer ring 3 can be prevented. Therefore, the distance between the retainer ring 3 and the circumferential edge of the wafer can be constantly minimized, and uniformity and stability in the polishing of the outer circumferential portion of the wafer W can be ensured.

Since the retainer ring 3 is fixedly connected to the wafer holder body 2, the retainer ring can be imparted with high rigidity and the behavior of the retainer ring during polishing can be stabilized. The wafer holding pressurizing mechanism of a floating type structure follows undulations in the polishing surface inside the retainer ring which is stable and has high rigidity. Consequently, the behavior of the retainer ring can be stabilized, even on a hard polishing surface, to thereby achieve excellent stability of the polishing of the wafer.

By adjustably positioning the stoppers 17, upward movement of the elastic membrane supporting member 5 is restricted at a predetermined height, thus limiting upward movement of the chucking plate 14 to a predetermined range. This prevents warpage of the wafer held on the elastic membrane 4 and a lowering of product quality such as breakage of the wafer. Further, by protruding the stoppers 17 by using the cylinder mechanism and pressing the elastic membrane supporting member 5 downward during polishing, the pressure for pressing the wafer W against the polishing surface can be varied on a part of the wafer surface, thus making it possible to obtain desired polishing properties in relation to the profile of the surface to be polished.

In the wafer holder shown in FIG. 3, in which the through-holes 4*h* are formed in the elastic membrane 4, the elastic membrane 4 directly holds the wafer W due to the effect of vacuum force applied through the through-holes 4*h*. Therefore, there is no problem of a change in properties of the elastic membrane 4 due to contact with the chucking plate 14 shown in FIG. 1. This enhances stability of uniform polishing of the wafer. Further, for holding the wafer W, it is unnecessary to utilize the effect of a suction cup formed by using the chucking plate 14. Therefore, there is no need to provide the chucking plate 14 and only the elastic membrane supporting member 5 in an annular form is necessary.

Figure 4A:
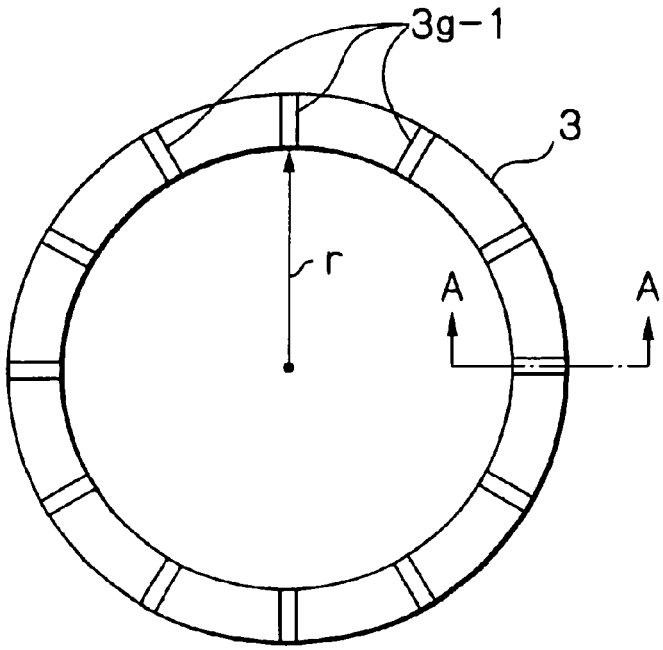
FIG. 4A is a bottom view of an example of a retainer ring having grooves formed on a lower surface thereof.
Figure 4B:
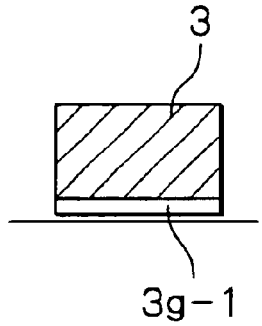
FIG. 4B is a cross-sectional view, taken along line A—A in FIG. 4A.
Figure 5A:
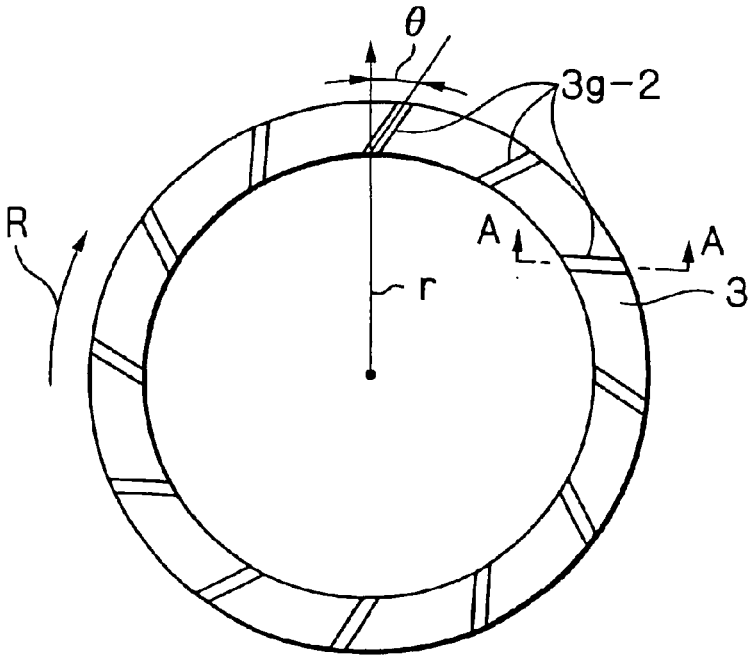
FIG. 5A is a bottom view of another example of a retainer ring having grooves formed on a lower surface thereof.
Figure 5B:
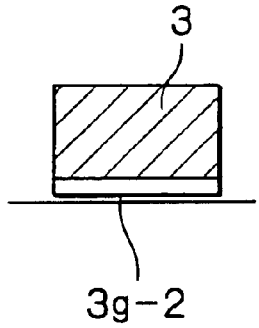
FIG. 5B is a cross-sectional view, taken along line A—A in FIG. 5A.
Figure 6A:
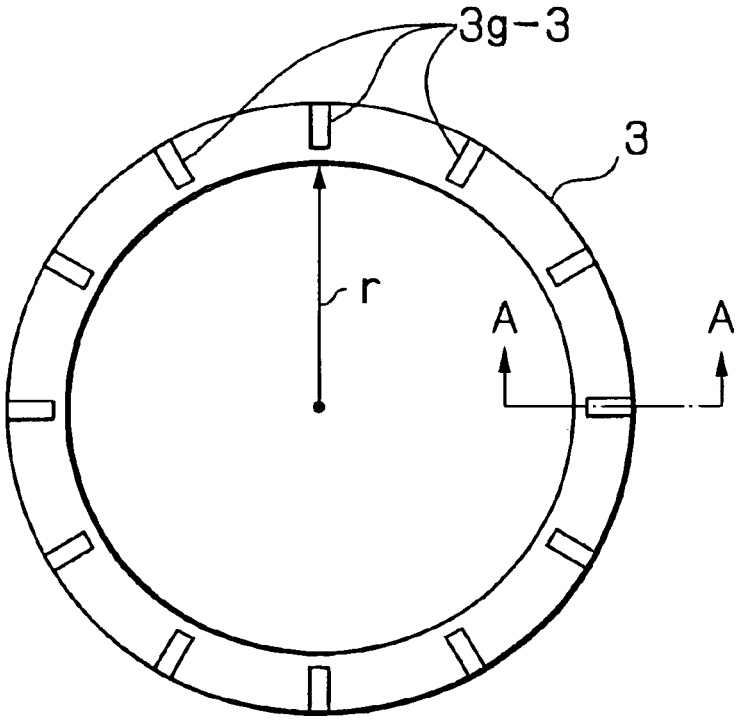
FIG. 6A is a bottom view of a further example of a retainer ring having grooves formed on a lower surface thereof.
Figure 6B:
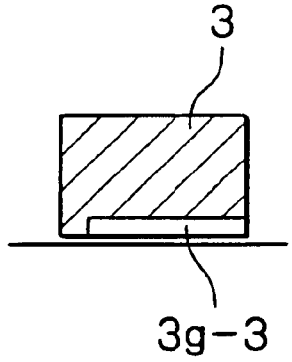
FIG. 6B is a cross-sectional view, taken along line A—A in FIG. 6A.

FIGS. 4A to 6B show examples of retainer rings having grooves formed on lower surfaces thereof. FIG. 4A, FIG. 5A and FIG. 6A are bottom views of the retainer rings. FIG. 4B, FIG. 5B and FIG. 6B are cross-sectional views, taken along lines A—A in FIG. 4A, FIG. 5A and FIG. 6A, respectively.

In the example of FIGS. 4A and 4B, a plurality of radial grooves 3*g*-1 (each extending in a radial direction indicated by an arrow r) is formed on the lower surface of the retainer ring 3.

In the example of FIGS. 5A and 5B, a plurality of grooves 3*g*-2 inclined at a predetermined angle θ relative to the radial direction r is formed on the lower surface of the retainer ring 3.

In the example of FIGS. 6A and 6B, a plurality of radial grooves 3*g*-3 (each extending in the radial direction r) is formed on the lower surface of the retainer ring 3. The radial grooves 3*g*-3 extend from an outer circumferential edge of the retainer ring 3 to an intermediate position at a slight distance from an inner circumferential edge of the retainer ring.

Because the retainer ring presses the polishing surface (such as a polishing pad) outside the wafer, when the entire lower surface of the retainer ring is flat, the abrasive liquid (slurry) might not smoothly flow into an area inside the retainer ring. That is, the amount of abrasive liquid supplied to the wafer becomes insufficient, leading to a lowering of uniformity in the polishing of the wafer and a lowering of a rate of polishing. Further, the wafer and the polishing surface are subject to high friction, leading to a problem, namely a high power load on the polishing apparatus.

As a countermeasure, it is considered to reduce the width of the lower surface of the retainer ring so as to minimize the effect of the retainer ring of disturbing the inflow of abrasive liquid. In this case, however, the flat portion of the lower surface of the retainer ring is reduced in area due to non-uniform wear of the lower surface of the retainer ring, making it difficult for the retainer ring to press the polishing surface in a stable manner. Further, the amount of wear of the retainer ring becomes large, thereby reducing the life of the retainer ring.

In the present invention, as shown in FIGS. 4A and 4B, the grooves 3*g*-1 may be formed on the lower surface of the retainer ring 3 which is brought into contact with the polishing surface. By this arrangement, the abrasive liquid smoothly flows into an area inside the retainer ring 3 to thereby secure the supply of abrasive liquid to the wafer, thus preventing a lowering of uniformity in the polishing of the wafer and a lowering of a rate of polishing. As shown in FIGS. 5A and 5B, the grooves 3*g*-2 inclined relative to the radial direction may be formed on the lower surface of the retainer ring. The direction of inclination of the grooves 3*g*-2 corresponds to a rotation direction R of the retainer ring 3. This enhances smooth flow of the abrasive liquid to the wafer. However, when there is a high possibility of accelerating polishing on a part of the wafer due to oversupply of the abrasive liquid, the grooves 3*g*-3 in FIGS. 6A and 6B may be formed on the lower surface of the retainer ring. The grooves 3*g*-3 do not extend to the inner circumferential edge of the retainer ring 3, so as to leave a wall portion for preventing oversupply of the abrasive liquid, thereby preventing excessive polishing of a part of the wafer while securing the supply of abrasive liquid to the wafer inside the retainer ring.

Another advantage of the grooves 3*g*-3 is explained below. When the grooves extend to the inner circumferential edge of the retainer ring, the following problems arise. That is, when relative rotation between the wafer holder and the wafer occurs, an angular portion of the outer circumferential surface of the wafer, which is formed by forming an orientation flat or a notch in the wafer, makes contact with the groove of the retainer ring. Consequently, a portion around the groove at the inner circumferential edge of the retainer ring is likely to become worn due to impact. The orientation flat is especially liable to cause such a wear. Further, pronounced noise is even generated due to impact when the orientation flat makes contact with the groove. The wear at the groove of the retainer ring can be prevented by leaving a wall portion at a terminal end of the groove of the retainer ring as shown in FIGS. 6A and 6B.

Figure 7:
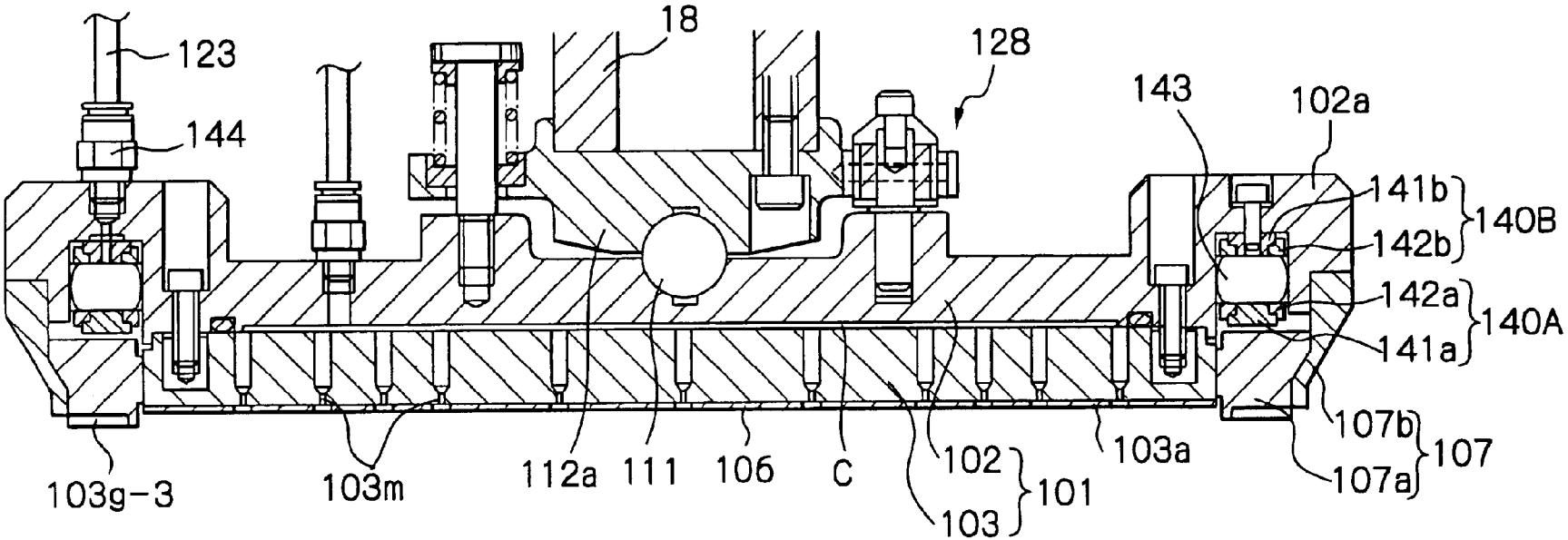
FIG. 7 is a longitudinal sectional view of a substrate holding apparatus according to third embodiment of the present invention.

The formation of grooves on the lower surface of the retainer ring can be applied to not only wafer holders such as those shown in FIGS. 1 to 3, but also various wafer holders as long as they are capable of pressing the retainer ring against the polishing surface. FIG. 7 shows an illustrative example of a wafer holder other than that shown in FIGS. 1 to 3.

In the example of FIG. 7, a wafer holder 101 comprises a wafer holder body 102 and a holding plate 103 for holding an upper surface of a substrate to be polished, such as a semiconductor wafer W. The holding plate 103 is made of a material having high rigidity, such as a ceramic, and has a wafer holding surface 103*a* which is adapted so as not to be deformed. An elastic mat 106 is adhered to a lower surface of the holding plate 103.

In order to hold the wafer W on the lower surface of the holding plate 103, a retainer ring (or guide ring) 107 for holding an outer circumferential surface of the wafer W is provided on an outer circumferential surface of the wafer holder 101. A chamber C is formed between the holding plate 103 and the wafer holder body 102. The chamber C is used for applying a fluid pressure through communication holes 103*m* formed in the holding plate 103 to a back side of the wafer W. By evacuating the chamber C by means of a vacuum pump, the wafer W can be held on the wafer holding surface 103*a* due to the effect of vacuum force. It should be noted that for separating the wafer W from the wafer holding surface 103*a* of the holding plate 103, a liquid such as pure water is supplied to the chamber C.

In the example of FIG. 7, a wafer held on the lower surface of the wafer holder is pressed against the polishing surface by an air cylinder for moving the wafer holder drive shaft 18 in a vertical direction. The retainer ring 107 having grooves 103*g*-3 formed on a lower surface thereof is disposed so that it surrounds the wafer. The retainer ring 107 is independently pressed against the polishing surface due to the effect of pressure of a pressurized fluid supplied to a space 143. The space 143 is defined by a lower seal ring 140A and an upper seal ring 140B. The upper seal ring 140B comprises a ring 141*b* fixed to a mounting flange portion 102*a* of the wafer holder body 102 and lip seals 142*b* for sealing spaces between the ring 141*b* and a mounting flange portion 102*a* of the wafer holder body 102. The lower seal ring 140A comprises a ring 141*a* for pressing the retainer ring 107 and lip seals 142*a* provided radially inside and outside the retainer ring 141*a* for sealing spaces between the ring 141*a* and the mounting flange portion 102*a* of the wafer holder body 102. The retainer ring 107 comprises a first retainer ring member 107*a* which is vertically movable and a second retainer ring member 107*b* fixed to the wafer holder body 102. In the embodiment of FIG. 7, even when the retainer ring 107 is worn, the retainer ring can be pressed under a desired pressure. The grooves 103*g*-3 formed in the retainer ring 107 are of the same type as the grooves 3*g*-3 in FIGS. 6A and 6B. That is, the grooves 103*g*-3 extend from the radially outer peripheral edge of the retainer ring and short of the radially inner peripheral edge of the same. The effects of the grooves 103*g*-3 are the same as those described above in connection with the grooves 3*g*-3. The grooves 103*g*-3 may be inclined at a predetermined angle (θ) relative to the radial direction r, as shown in FIG. 5A.

Figure 8:
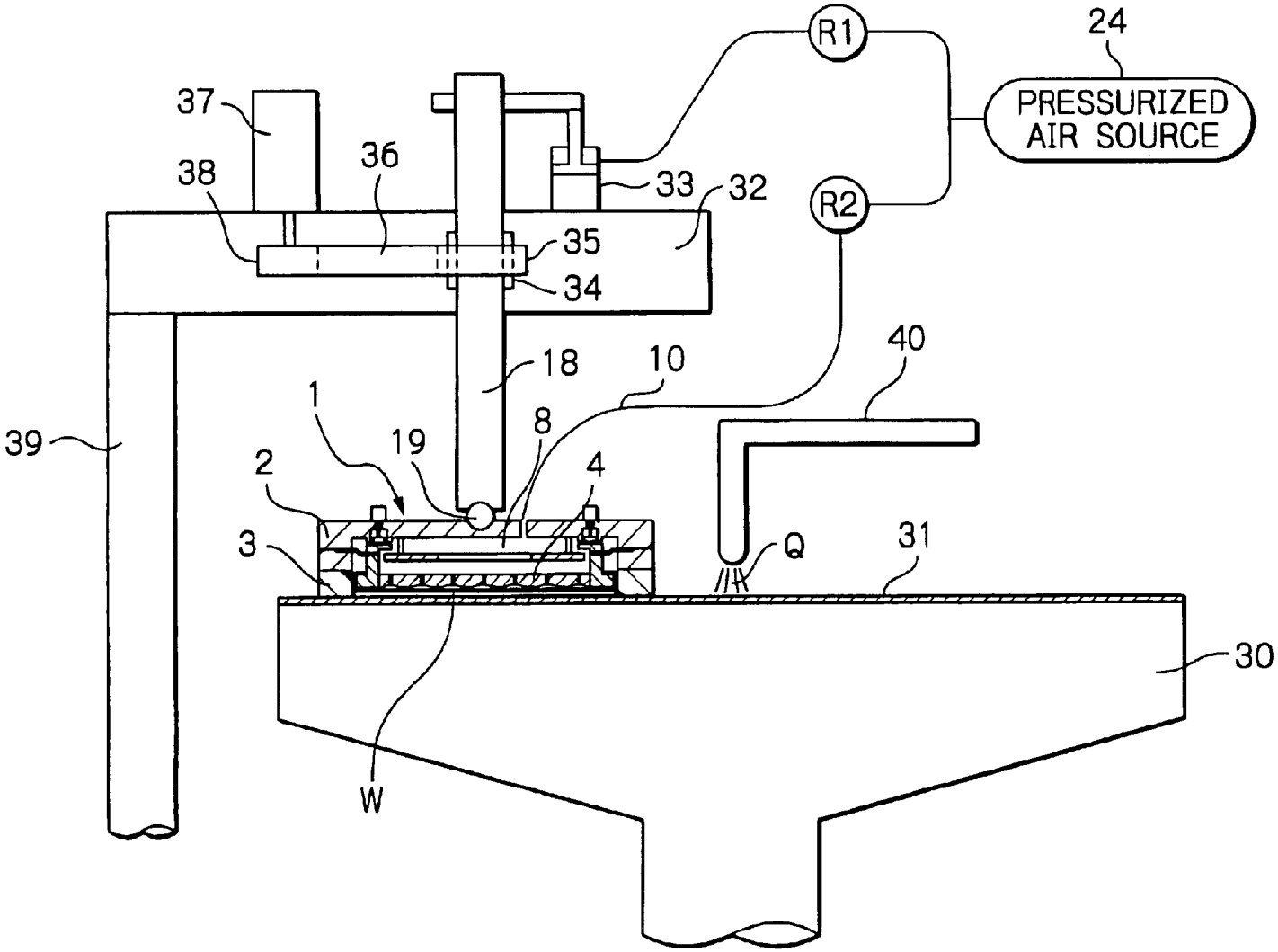
FIG. 8 is a schematic view showing an entire structure of a polishing apparatus including the substrate holding apparatus of FIGS. 1 to 3.

FIG. 8 is a cross-sectional view showing an entire structure of a polishing apparatus including the substrate holding apparatus of FIGS. 1 to 3. As shown in FIG. 8, the polishing table 30 has a polishing pad 31 attached to an upper surface thereof and is provided below the wafer holder 1.

The wafer holder 1 is connected to the drive shaft 18 through the universal joint 19. The drive shaft 18 is connected to the air cylinder 33 fixed to a wafer holder head 32. The drive shaft 18 is vertically moved by means of the air cylinder 33, thereby moving the wafer holder 1 as a whole in a vertical direction and pressing the retainer ring 3 fixed to the wafer holder body 2 against the polishing table 30.

The drive shaft 18 is connected to a rotary cylinder 34 through a key (not shown). The rotary cylinder 34 has a timing pulley 35 on an outer circumferential surface thereof. The timing pulley 35 is connected through a timing belt 36 to a timing pulley 38 which is connected to a wafer holder motor 37 fixed to the wafer holder head 32. Therefore, the rotary cylinder 34 and the drive shaft 18 are rotated as a unit by the wafer holder motor 37 through the timing pulley 38, the timing belt 36 and the timing pulley 35 to thereby rotate the wafer holder 1. The wafer holder head 32 is supported by a wafer holder head shaft 39 fixedly supported by a frame (not shown).

The air cylinder 33 and the fluid chamber 8 are, respectively, connected through a regulator R1 and a regulator R2 to a pressurized air source 24. The pressure of pressurized air supplied to the air cylinder 33 is controlled by the regulator R1, to thereby adjust the pressure for pressing the retainer ring 3 against the polishing pad 31. The pressure of pressurized air supplied to the fluid chamber 8 is controlled by the regulator R2, to thereby adjust the pressure for pressing the wafer W against the polishing pad 31.

An abrasive liquid supply nozzle 40 is provided above the polishing table 30. An abrasive liquid Q is supplied onto the polishing pad 31 on the polishing table 30 through the abrasive liquid supply nozzle 40.

In this polishing apparatus, for polishing, while holding the wafer W on the lower surface of the elastic membrane 4 of the wafer holder 1, the air cylinder 33 is operated to thereby press the retainer ring 3 fixed to the wafer holder body 2 toward the polishing table 30, and pressurized air is supplied to the fluid chamber 8 to thereby press the wafer W against the polishing pad 31 on the polishing table 30, which is rotating. On the other hand, the abrasive liquid Q is supplied from the abrasive liquid supply nozzle 40 so as to retain the abrasive liquid Q on the polishing pad 31. Thus, polishing is conducted while retaining the abrasive liquid Q between the wafer surface to be polished (a lower surface of the wafer W) and the polishing pad 31.

For polishing, the pressure for pressing the retainer ring 3 against the polishing pad 31, which is applied through the air cylinder 33, and the pressure for pressing the wafer W against the polishing pad 31, which is applied by means of pressurized air supplied to the fluid chamber 8, are adjusted to a desired level. During polishing, the pressure for pressing the retainer ring 3 against the polishing pad 31 can be varied by means of the regulator R1, and the pressure for pressing the wafer W against the polishing pad 31 can be varied by means of the regulator R2. Consequently, during polishing, by controlling the pressure for pressing the retainer ring 3 against the polishing pad 31 and the pressure for pressing the wafer W against the polishing pad 31, a uniform pressure distribution can be obtained continuously across an area from the center of the wafer W to an outer circumferential portion of the retainer ring 3 outside the wafer W. Therefore, excessive or insufficient polishing at the circumferential edge of the wafer W can be prevented.

In the present invention, the polishing surface formed on the polishing table may be prepared by a polishing pad such as that described above or an abrasive plate comprising fixed abrasive particles. As the polishing pad, various commercially available polishing pads, for example, SUBA800, IC-1000 and IC-1000/SUBA400 (a two-layered cloth) manufactured and sold by Rodel, Inc., and Surfin xxx-5 and Surfin 000 manufactured and sold by FUJIMI INCORPORATED can be used. The SUBA800, Surfin xxx-5 and Surfin 000 are non-woven cloths which comprise fibers bound by using a urethane resin. The IC-1000 comprises a single layer of hard, foamed polyurethane, which has a porous structure and includes a number of fine recesses or holes formed on a surface thereof.

The abrasive plate comprises fixed abrasive particles which are bound by using a binder and formed into a plate. Polishing is conducted by utilizing the abrasive particles freed from the abrasive plate. The abrasive plate comprises the abrasive particles, the binder and pores. Examples of abrasive particles include particles of cerium oxide ($CeO_2$) having an average particle diameter of 0.5 $\mu$m or less. As the binder, for example, an epoxy resin is used. The abrasive plate provides a hard polishing surface. The abrasive plate may have a two-layered structure comprising a thin layer of fixed abrasive particles and an elastic polishing pad adhered to a lower side of the fixed abrasive particles. The above-mentioned IC-1000 also provides a hard polishing surface.

The wafer holder of the present invention is suitable for use with a polishing member having a hard polishing surface, especially suitable for a polishing surface having a modulus of elasticity of compression of 19.6 MPa (200 kg/cm$^2$) or more.

In a conventional wafer holder, a wafer is held on a backing pad provided on a rigid wafer holder body. Because the polishing pad is elastic, shocks on the wafer are absorbed by the polishing pad. However, when a hard polishing surface is used, undulation on the polishing surface is transferred to and affects the wafer surface to be polished. Further, a mark corresponding to a vacuum opening of the backing pad is formed on a rear surface of the wafer.

On the other hand, in the wafer holder of the present invention in which a wafer is held on an elastic membrane by utilizing fluid pressure, shocks on the wafer due to a hard, undulating polishing surface can be absorbed by the fluid pressure acting on the rear surface of the wafer. Thus, even when the polishing surface is hard, high polishing performance can be maintained and no mark corresponding to the vacuum opening is formed on the wafer.

Further, in the present invention, since the retainer ring is fixedly connected to the wafer holder body, the retainer ring can be imparted with high rigidity and unstable movement of the retainer ring can be suppressed, thereby stabilizing polishing performance.

Figure 9:
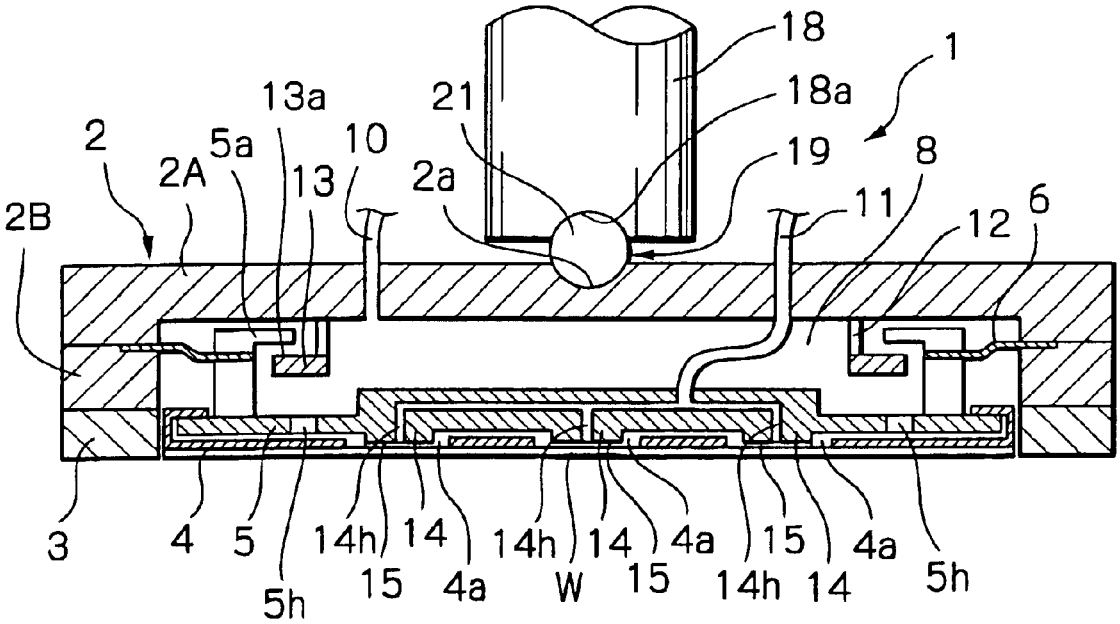
FIG. 9 is a longitudinal sectional view of a substrate holding apparatus according to a fourth embodiment of the present invention.
Figure 10:
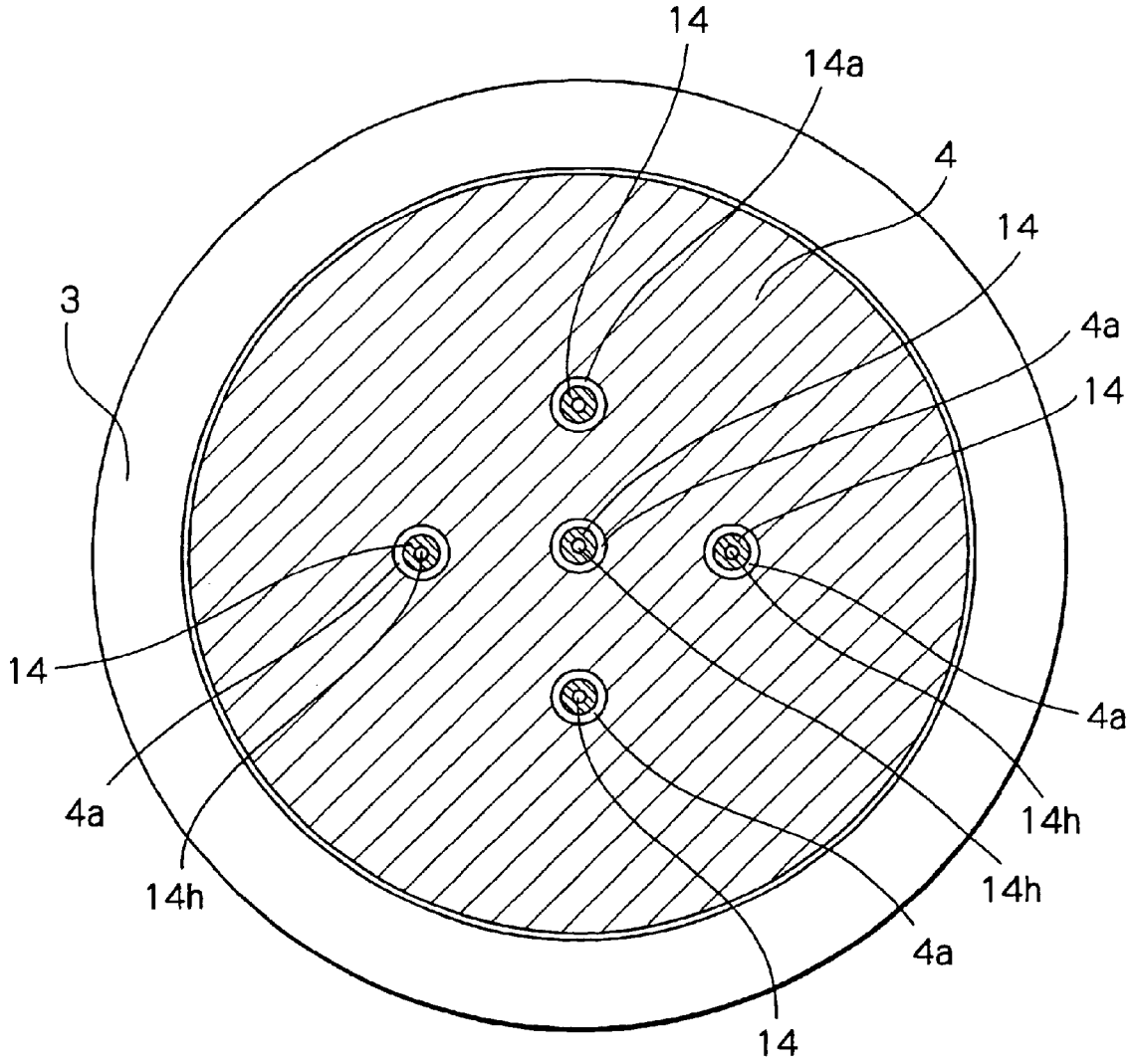
FIG. 10 is a bottom view of the substrate holding apparatus of FIG. 9.
Figure 11:
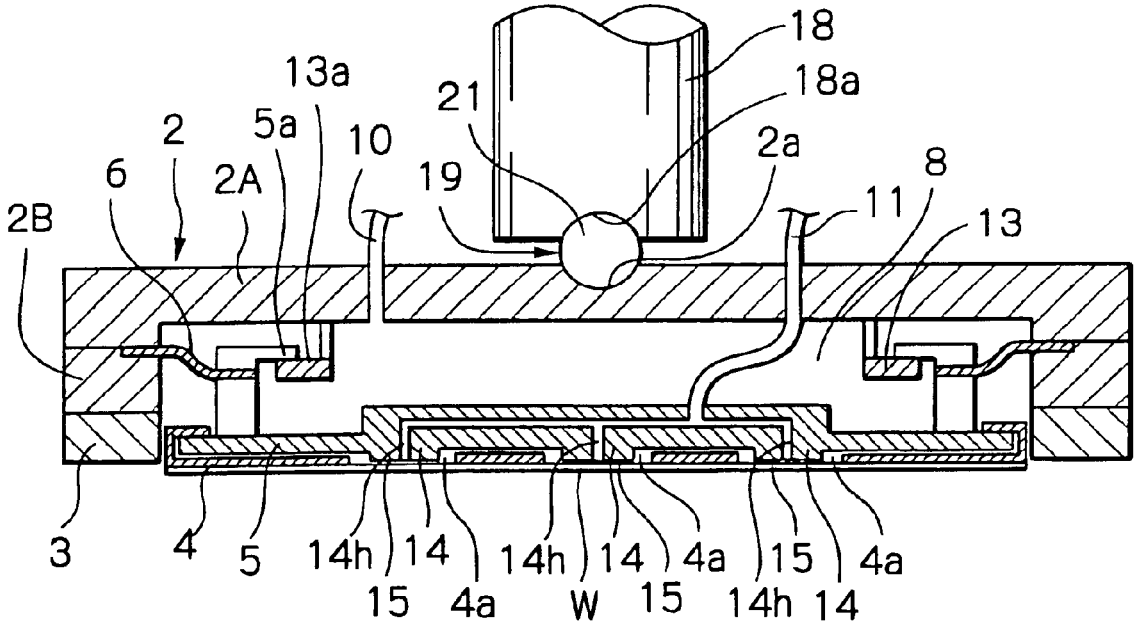
FIG. 11 is a longitudinal sectional view showing how the substrate holding apparatus of FIG. 9 is operated.

FIG. 9 is a longitudinal sectional view of a substrate holding apparatus 1 according to another embodiment of the present invention. FIG. 10 is a bottom view of the substrate holding apparatus of FIG. 9. FIG. 11 is a sectional view showing how the substrate holding apparatus of FIG. 9 is operated.

The substrate holding apparatus 1 is adapted to hold a substrate to be polished, such as a semiconductor wafer, and press the wafer against a polishing surface of a polishing table. As shown in FIG. 9, the substrate holding apparatus of this embodiment comprises a dish-like wafer holder body 2 defining an inner space and a retainer ring 3 fixed to a lower end of the wafer holder body 2. The wafer holder body 2 is made of a material having high strength and high rigidity, such as a metal and a ceramic, and comprises a circular upper plate 2A and a circumferential wall portion 2B extending downward from the upper plate 2A. The retainer ring 3 is fixed to a lower end of the circumferential wall portion 2B. The retainer ring 3 is made of a resin material having high rigidity. It should be noted that the retainer ring 3 may be formed integrally with the wafer holder body 2.

The wafer holder body 2 and the retainer ring 3 define an inner space for containing an elastic membrane 4 and an elastic membrane supporting member 5 in a generally disk-like form. The elastic membrane supporting member 5 holds an outer circumferential portion of the elastic membrane 4. A flexible sheet 6 made of an elastic membrane extends between the elastic membrane supporting member 5 and the wafer holder body 2. A fluid chamber 8 is formed by the wafer holder body 2, the elastic membrane 4, the flexible sheet 6 and an inner surface of the wafer holder body 2. Each of the elastic membrane 4 and the flexible sheet 6 is formed from a rubber material which is excellent in strength and durability, such as an ethylene propylene rubber (EPDM), a polyurethane rubber or a silicone rubber. A pressurized fluid such as pressurized air is supplied to the fluid chamber 8 through a fluid passage 10 comprising a tube and a connector. The pressurized fluid supplied to the fluid chamber 8 flows through through-holes 5*h* formed in the elastic membrane supporting member 5 to a rear surface of the elastic membrane 4, thus applying the pressure of pressurized fluid to the rear surface of the elastic membrane 4. The pressure of pressurized fluid supplied to the fluid chamber 8 can be varied by means of a regulator. A slight gap is formed between an outer circumferential surface of the elastic membrane 4 and the wafer holder body 2 and the retainer ring 3. The elastic membrane 4 and the elastic membrane supporting member 5 are vertically movable relative to the wafer holder body 2 and the retainer ring 3.

For insuring high polishing performance, it is preferred to form the fluid chamber 8 by using an elastic membrane as in this embodiment. However, the elastic membrane 4 may not be used so that the wafer may be pressed by direct contact with the fluid. When the elastic membrane 4 is not used, the fluid chamber is formed by the wafer holder body 2 and the rear surface of the wafer to be polished.

An annular stopper plate 13 is fixed through a support member 12 to the upper plate 2A of the wafer holder body 2. An upper end surface 13*a* of the stopper plate 13 is positioned at a predetermined height and the stopper plate 13 provides a restricting member. When the pressurized fluid is supplied to the fluid chamber 8, the elastic membrane 4 and the elastic membrane supporting member 5 move as a unit downward relative to the wafer holder body 2. In this instance, an upper end portion 5*a* of the elastic membrane supporting member 5 engages the upper end surface 13*a* of the stopper plate 13, thus limiting the downward movement of the elastic membrane 4 and the elastic membrane supporting member 5 to a predetermined range. The elastic membrane 4 includes a plurality of openings 4*a* formed therein. Vacuum portions 14 each having a communication hole 14*h* are exposed from the respective openings 4*a*. The vacuum portions 14 are formed at a central portion of the elastic membrane supporting member 5. In this embodiment, the vacuum portions 14 are formed integrally with the elastic membrane supporting member 5. However, the elastic membrane supporting member 5 may be formed into an annular form and a disk-like chucking plate including a plurality of vacuum portions 14 may be employed so that the chucking plate is fixed to an inner side of the elastic membrane supporting member 5.

As shown in FIG. 10, five openings 4*a* are formed at a central portion of the elastic membrane 4, and the vacuum portions 14 are exposed from the respective openings 4*a*. As shown in FIG. 9, a lower end of the communication hole 14*h* of each vacuum portion 14 is open. All the communication holes 14*h* join inside the elastic membrane supporting member 5 and are connected through a tube 11 in the fluid chamber 8 to a vacuum source. When a negative pressure is applied to the open ends of the communication holes 14*h* through the vacuum source, a semiconductor wafer W is held on the vacuum portions 14 under vacuum force. As shown in FIG. 9, during polishing, the vacuum portions 14 are located inward of a lower end surface of the elastic membrane 4 and do not protrude from the lower end surface of the elastic membrane 4. When the wafer W is held under vacuum force, as shown in FIG. 11, lower end surfaces of the vacuum portions 14 become substantially flush with the lower end surface of the elastic membrane 4. An elastic sheet 15 such as a thin rubber sheet is attached to the lower end surface of each vacuum portion 14 so that the vacuum force is applied to the wafer through the thin rubber sheet.

A wafer holder drive shaft 18 is provided above the upper plate 2A of the wafer holder body 2. The drive shaft 18 and the wafer holder body 2 are connected through a universal joint 19. The universal joint 19 transmits pressure and torque of the drive shaft 18 to the wafer holder body 2 while permitting inclination of the drive shaft 18 and the wafer holder body 2 relative to each other. The universal joint 19 comprises a spherical bearing mechanism which permits inclination of the wafer holder body 2 and the drive shaft 18 relative to each other and a torque transmitting mechanism which transmits rotation of the drive shaft 18 to the wafer holder body 2. The spherical bearing mechanism comprises a spherical recess 18*a* formed at a central portion of a lower surface of the drive shaft 18, a spherical recess 2*a* formed at a central portion of an upper surface of the upper plate 2A and a bearing ball 21 made of a material having high hardness, such as a ceramic, provided between the spherical recess 18*a* and the spherical recess 2*a*.

The torque transmitting mechanism comprises a drive pin (not shown) fixed to the drive shaft 18 and a driven pin (not shown) fixed to the upper plate 2A. The two pins are capable of moving vertically relative to each other and engaging at different contact positions. Therefore, a torque of the drive shaft 18 is surely transmitted to the wafer holder body 2 even when the wafer holder body 2 is inclined.

Next, explanation is made with regard to operation of the wafer holder 1 explained with reference to FIGS. 9-11.

The wafer holder 1 as a whole is moved to a position for transferring a wafer and the communication holes 14*h* of the vacuum portions 14 are connected to the vacuum source through the tube 11. Consequently, as shown in FIG. 11, the wafer W is held on the lower end surfaces of the vacuum portions 14 due to the effect of vacuum force applied through the communication holes 14*h*. In this instance, a slight positive pressure is applied to the fluid chamber 8 so as to prevent upward movement of the elastic membrane supporting member 5 and the vacuum portions 14, and the upper end portion 5*a* of the elastic membrane supporting member 5 engages the upper end surface 13*a* of the stopper plate 13 to thereby hold the elastic membrane supporting member 5 and the vacuum portions 14 at a predetermined position. While holding the wafer W under vacuum force, the wafer holder 1 is moved to a position above a polishing table (designated by reference numeral 30 in FIG. 12) having a polishing surface (such as a polishing pad). The wafer W and the retainer ring 3 are then pressed against the polishing surface to thereby start polishing. An outer circumferential edge of the wafer W is held by the retainer ring 3 so that the wafer W is not separated from the wafer holder 1.

For polishing the wafer W, an air cylinder (designated by reference numeral 33 in FIG. 12) connected to the drive shaft 18 is operated, to thereby press the retainer ring 3 fixed to the wafer holder body 2 against the polishing surface of the polishing table under a predetermined pressure. In this state, the pressurized fluid is supplied under a predetermined pressure to the fluid chamber 8, to thereby press the wafer W against the polishing surface of the polishing table. The pressure applied to the wafer W for polishing is adjusted to a desired level by controlling the pressure of pressurized fluid supplied to the fluid chamber 8. Thus, the fluid pressure is directly applied to the wafer W at its portion corresponding to the opening 4*a*, while the fluid pressure is indirectly applied to the remaining portion of the wafer W through the elastic membrane 4. However, the pressures applied to these two portions of the wafer W are equal. That is, since the pressure of fluid in the fluid chamber 8 is applied to an entire surface of the wafer W, it is possible to obtain a uniform pressure distribution for polishing across an entire surface of the wafer W from the center to the circumferential edge thereof, regardless of the thickness of the wafer W. This enables uniform polishing of the entire surface of the wafer W. During polishing, the elastic membrane 4 is in intimate contact with the rear surface of the wafer W around the openings 4*a*, so that there is substantially no leakage of the pressurized fluid from the fluid chamber 8 to the outside.

During polishing, pressure substantially equal to or slightly higher than that applied to the wafer W is applied to the retainer ring 3 through the air cylinder, so that the polishing surface outside the wafer W is pressed under a pressure substantially equal to that of the wafer W. Therefore, a uniform pressure distribution can be obtained continuously across an area from the center of the wafer W to an outer circumferential portion of the retainer ring 3 outside the wafer W. Therefore, excessive or insufficient polishing at the circumferential edge of the wafer W can be prevented.

In the wafer holder shown in FIGS. 9 to 11, the retainer ring 3 is fixedly connected to the wafer holder body 2 having a rigid construction and the retainer ring 3 is vertically moved by vertically moving the wafer holder body 2. By this arrangement, the pressure applied to the wafer holder body 2 can be utilized as a pressure for pressing the retainer ring 3. Further, because the retainer ring 3 is fixed to the wafer holder body 2, undesirable lateral (or radial) movement of the retainer ring 3 can be prevented. Therefore, the distance between the retainer ring 3 and the circumferential edge of the wafer surface can be constantly minimized, and uniformity and stability in the polishing of the outer circumferential portion of the wafer W can be ensured.

Since the retainer ring 3 is fixedly connected to the wafer holder body 2, the retainer ring can be imparted with high rigidity and the behavior of the retainer ring during polishing can be stabilized. The wafer holding pressurizing mechanism of a floating type structure follows undulation of the polishing surface inside the retainer ring which is stable and has high rigidity. Consequently, the behavior of the retainer ring can be stabilized even on a hard polishing surface to thereby achieve excellent stability of the polishing of the wafer.

The openings 4*a* are formed in the elastic membrane 4 and the vacuum portions 14 having the communication holes 14*h* are provided in the openings 4*a*. The wafer W is held due to the effect of vacuum force applied through the communication holes 14*h* connected to the vacuum source. That is, the vacuum portions 14 directly hold the wafer W due to the effect of vacuum force. Therefore, there is no need to impart the elastic membrane 4 with a suction cup-like configuration. Therefore, a change in properties of the elastic membrane 4 is unlikely to occur so that uniformity in the polishing of wafers can be stably maintained.

Figure 12:
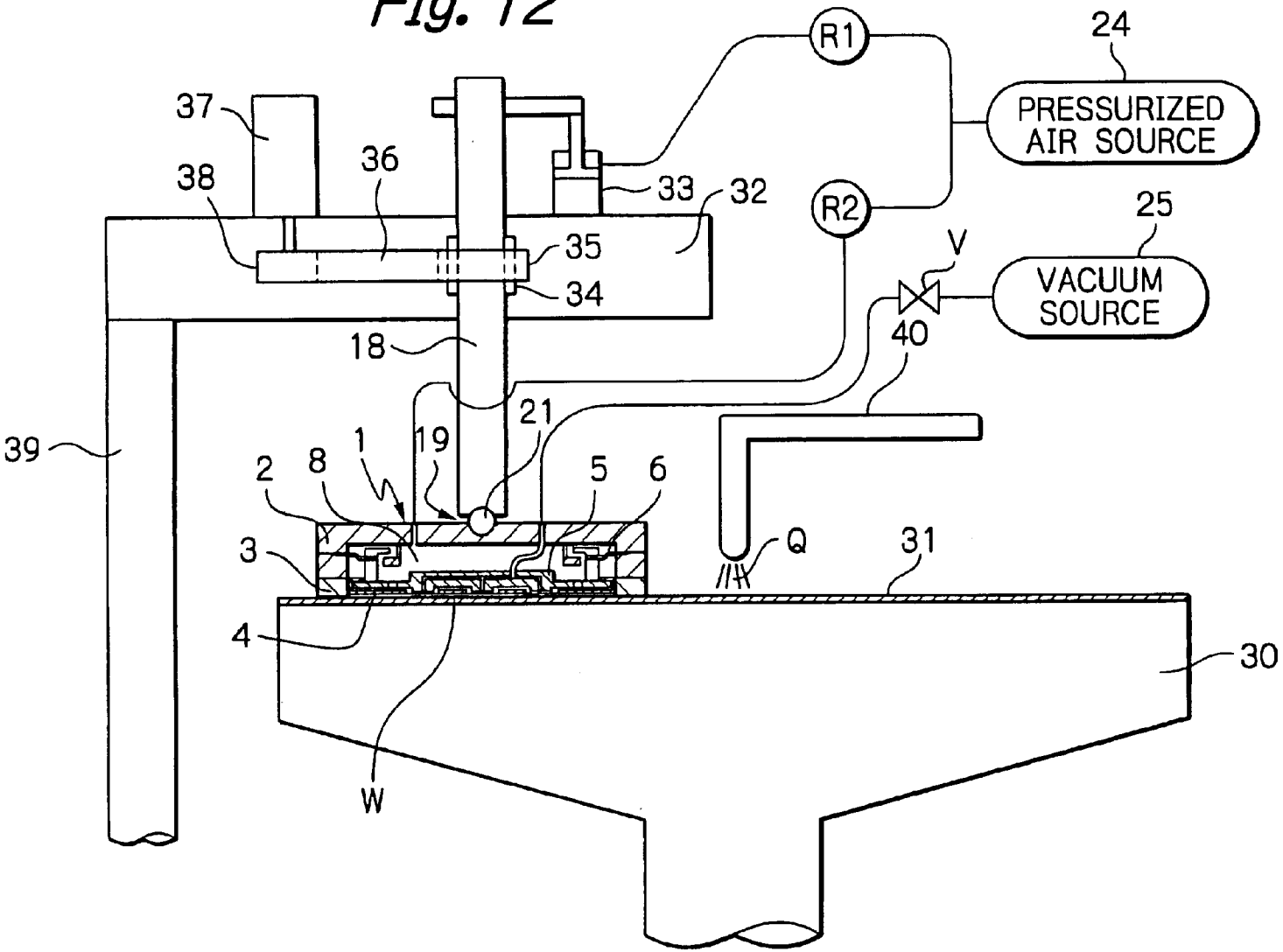
FIG. 12 is a schematic view showing an entire structure of a polishing apparatus including the substrate holding apparatus of FIGS. 9 to 11.

FIG. 12 is a cross-sectional view showing an entire structure of a polishing apparatus including the substrate holding apparatus of FIGS. 9 to 10. As shown in FIG. 12, the polishing table 30 has a polishing pad 31 attached to an upper surface thereof and is provided below the wafer holder 1.

The wafer holder 1 is connected to the drive shaft 18 through the universal joint 19. The drive shaft 18 is connected to the air cylinder 33 fixed to a wafer holder head 32. The drive shaft 18 is vertically moved by means of the air cylinder 33, thereby moving the wafer holder 1 as a whole in a vertical direction and pressing the retainer ring 3 fixed to the wafer holder body 2 against the polishing table 30.

The drive shaft 18 is connected to a rotary cylinder 34 through a key (not shown). The rotary cylinder 34 has a timing pulley 35 on an outer circumferential surface thereof. The timing pulley 35 is connected through a timing belt 36 to a timing pulley 38 which is connected to a wafer holder motor 37 fixed to the wafer holder head 32. Therefore, the rotary cylinder 34 and the drive shaft 18 are rotated as a unit by the wafer holder motor 37 through the timing pulley 38, the timing belt 36 and the timing pulley 35 to thereby rotate the wafer holder 1. The wafer holder head 32 is supported by a wafer holder head shaft 39 fixedly supported by a frame (not shown).

The air cylinder 33 and the fluid chamber 8 are, respectively, connected through a regulator R1 and a regulator R2 to a pressurized air source 24. The pressure of pressurized air supplied to the air cylinder 33 is controlled by the regulator R1 to thereby adjust the pressure for pressing the retainer ring 3 against the polishing pad 31. The pressure of pressurized air supplied to the fluid chamber 8 is controlled by the regulator R2 to thereby adjust the pressure for pressing the wafer W against the polishing pad 31. The communication holes 14*h* of the vacuum portions 14 are connected through a valve V to a vacuum source 25 such as a vacuum pump.

An abrasive liquid supply nozzle 40 is provided above the polishing table 30. An abrasive liquid Q is supplied onto the polishing pad 31 on the polishing table 30 through the abrasive liquid supply nozzle 40.

In this polishing apparatus, for transferring the wafer W, the communication holes 14*h* of the vacuum portions 14 are communicated with the vacuum source 25 to thereby apply a vacuum force to the wafer W for holding the wafer W on the vacuum portions 14. For polishing, the vacuum force applied to the wafer W through the vacuum portions 14 is released and, while holding the wafer W on the lower end surface of the elastic membrane 4 of the wafer holder 1, the air cylinder 33 is operated to thereby press the retainer ring 3 fixed to the wafer holder body 2 toward the polishing table 30, and pressurized air is supplied to the fluid chamber 8, to thereby press the wafer W against the polishing pad 31 on the polishing table 30, which is rotating. On the other hand, the abrasive liquid Q is supplied from the abrasive liquid supply nozzle 40 so as to retain the abrasive liquid Q on the polishing pad 31. Thus, polishing is conducted while retaining the abrasive liquid Q between the wafer surface to be polished (a lower surface of the wafer W) and the polishing pad 31.

For polishing, the pressure for pressing the retainer ring 3 against the polishing pad 31, which is applied through the air cylinder 33, and the pressure for pressing the wafer W against the polishing pad 31, which is applied by means of pressurized air supplied to the fluid chamber 8, are adjusted to a desired level. During polishing, the pressure for pressing the retainer ring 3 against the polishing pad 31 can be varied by means of the regulator R1, and the pressure for pressing the wafer W against the polishing pad 31 can be varied by means of the regulator R2. Consequently, during polishing, by controlling the pressure for pressing the retainer ring 3 against the polishing pad 31 and the pressure for pressing the wafer W against the polishing pad 31, a uniform pressure distribution can be obtained continuously across an area from the center of the wafer W to an outer circumferential portion of the retainer ring 3 outside the wafer W. Therefore, excessive or insufficient polishing at the circumferential edge of the wafer W can be prevented.

In this embodiment, the polishing surface formed on the polishing table may be prepared by a polishing pad such as that described above or fixed abrasives. As the polishing pad, various commercially available polishing pads, for example, SUBA800, IC-1000 and IC-1000/SUBA400 (a two-layered cloth) manufactured and sold by Rodel, Inc., and Surfin xxx-5 and Surfin 000 manufactured and sold by FUJIMI INCORPORATED can be used. The SUBA800, Surfin xxx-5 and Surfin 000 are non-woven cloths which comprise fibers bound by using a urethane resin. The IC-1000 comprises a single layer of hard, foamed polyurethane, which has a porous structure and includes a number of fine recesses or holes formed on a surface thereof.

The fixed abrasives comprise particles which are bound by using a binder and formed into a plate. Polishing is conducted by utilizing abrasive particles freed from the abrasive plate. The abrasive plate comprises the abrasive particles, the binder and pores. Examples of abrasive particles include particles of cerium oxide ($CeO_2$) having an average particle diameter of 0.5 $\mu$m or less. As the binder, for example, an epoxy resin is used. The fixed abrasives provide a hard polishing surface. The fixed abrasives are generally formed into a disk-like plate and may have a two-layered structure comprising a thin layer of fixed abrasive particles and an elastic polishing pad adhered to a lower side of the fixed abrasive particles. The above-mentioned IC-1000 also provides a hard polishing surface.

The wafer holder of this embodiment is suitable for use with a polishing member having a hard polishing surface, and especially suitable for a polishing surface having a modulus of elasticity of compression of 19.6 MPa (200 kg/cm$^2$) or more.

In a conventional wafer holder, a wafer is held on a backing pad provided on a rigid wafer holder body. Because the polishing pad is elastic, shocks on the wafer are absorbed mainly by the polishing pad. However, when a hard polishing surface is used, undulation on the polishing surface is transferred to and affects the wafer surface to be polished. Further, a mark corresponding to a vacuum opening of the backing pad is formed on a rear surface of the wafer.

On the other hand, in the wafer holder of this embodiment in which a wafer is held on an elastic membrane by utilizing fluid pressure, shocks on the wafer due to a hard, undulating polishing surface can be absorbed by the fluid pressure acting on the rear surface of the wafer. Thus, even when the polishing surface is hard, a high polishing performance can be maintained and no mark corresponding to the vacuum opening is formed on the wafer.

Further, in this embodiment, since the retainer ring is fixedly connected to the wafer holder body, the retainer ring can be imparted with high rigidity and unstable movement of the retainer ring can be suppressed, thereby stabilizing polishing performance.

A highly flattened wafer surface having less scratch marks can be obtained by conducting two-stage polishing, that is, first conducting polishing of the wafer on a hard abrasive plate while the wafer is held by the wafer holder of the present invention (i.e., the wafer holder which holds a wafer under fluid pressure) and then conducting final polishing of the wafer on a polishing pad which is soft as compared to the abrasive plate while the wafer is held by the wafer holder of the present invention. It should be noted that "soft" means having a low modulus of elasticity.

Figure 13:
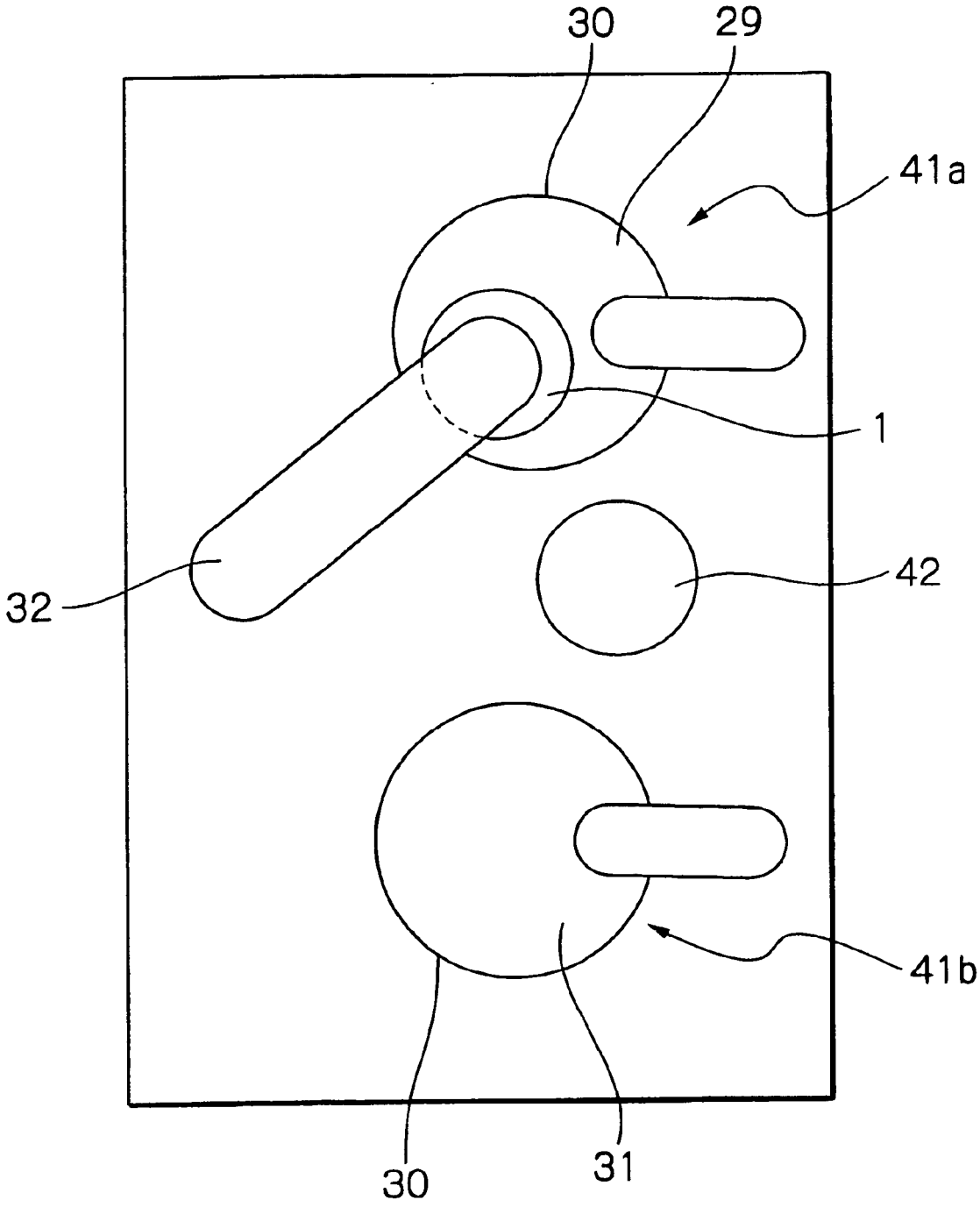
FIG. 13 is a plan view of a polishing apparatus which is suitably used for two-stage polishing by using the substrate holding apparatus of the present invention.
Figure 14:
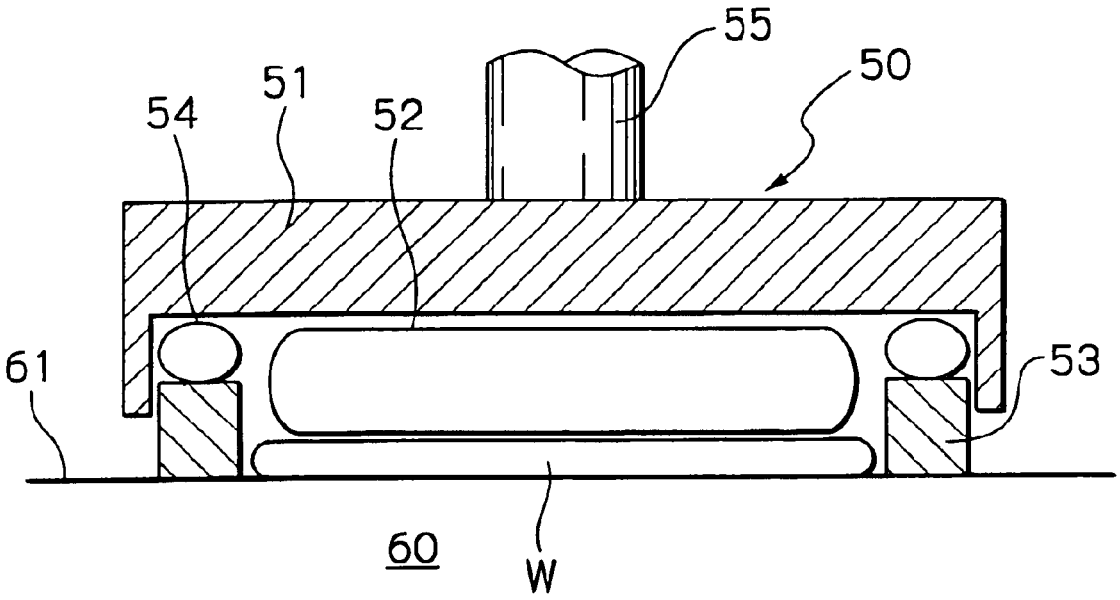
FIG. 14 is a schematic illustration of a conventional substrate holding apparatus in which a fluid pressure is applied to a wafer so as to press the wafer against a polishing surface, and the fluid pressure is also applied to a retainer ring so as to press the retainer ring against the polishing surface.

FIG. 13 is a plan view of a polishing apparatus which is suitably used for the above-mentioned two-stage polishing by using the wafer holder of the present invention. The polishing apparatus of FIG. 13 comprises two polishing tables 30. An abrasive plate or fixed abrasive polishing tool 29 is attached to one polishing table 30, to thereby provide a first polishing unit 41*a*. A polishing pad 31 is attached to the other polishing table 30, to thereby provide a second polishing unit 41*b*. The second polishing unit 41*b* can be used for final polishing. The polishing pad 31 of the second polishing unit 41*b* has a lower elastic modulus than that of the polishing tool fixed abrasive polishing tool of the first polishing unit 41*a*. A wafer holder 1 has the same structure as that shown in FIG. 1 to FIG. 3 or FIG. 9 to FIG. 11. The single wafer holder 1 is common to the first polishing unit 41*a* and the second polishing unit 41*b*. That is, as in the case of FIG. 8 or FIG. 12, the wafer holder 1 is supported by a wafer holder head 32. The wafer holder head is adapted to be pivotally moved by a wafer holder head shaft, and the wafer holder 1 is capable of moving between the fixed abrasive polishing tool 29 and the polishing pad 31. In this embodiment, the wafer W is picked up by a wafer holder 1 from a wafer supply lift 42, then moved to the first polishing unit 41*a* to conduct a first polishing of the wafer by the fixed abrasive polishing tool 29, thereafter to the second polishing unit 41*b* to conduct a second or final polishing of the same by the abrasive pad 31, and returned to the lift 42 to transfer the polished wafer to the lift. By this arrangement, a highly flattened wafer surface having fewer scratch marks can be obtained.

It should be noted that the present invention is not necessarily limited to the foregoing embodiments but can be modified in a variety of ways without departing from the gist of the present invention.

What is claimed is:

1. A substrate holding apparatus for holding a substrate and bringing it into contact with a polishing surface so that the substrate is subjected to polishing by causing relative movement between the substrate and the polishing surface, said apparatus comprising:

a substrate holder body having a substrate holding side facing the polishing surface and holding a substrate on said substrate holding side;

a retainer ring integrally formed with or fixedly secured to said substrate holder body on said substrate holding side, the retainer ring being arranged to surround an outer periphery of the substrate held by said substrate holder body so that the retainer ring engages with the polishing surface radially outside said substrate as the polishing of the substrate is effected, wherein said substrate holder body is provided on said substrate holding side with a membrane having opposite surfaces including inner and outer surfaces, the outer surface engaging with the substrate held by said substrate holder body, said substrate holder body and said retainer ring cooperate to define an inner space, and said membrane is provided in said inner space;

a membrane support member provided in said inner space and connected to the outer periphery of said membrane and a flexible seal member connected between said membrane support member and said substrate holder body so that a fluid pressure chamber is defined by said membrane, said membrane support member, said flexible seal member and said substrate holder body; and a drive shaft connected to said substrate holder body for rotating said substrate holder body while the substrate is kept urged against the polishing surface, said drive shaft being operable to urge the retainer ring against the polishing surface through said substrate holder body.

2. A substrate holding apparatus as set forth in claim 1, wherein said membrane is provided with one or more through holes extending between said inner and outer surfaces thereof.

3. A substrate holding apparatus as set forth in claim 1, wherein said apparatus further comprises a chucking plate positioned inside and connected to said membrane support member; and said chucking plate has opposite surfaces including an inner surface and an outer surface which is adjacent to said inner surface of said membrane and one or more through holes extending between said opposite surfaces thereof.

4. A substrate holding apparatus as set forth in claim 3, wherein said outer surface of said chucking plate is provided with one or more recesses fluidly connected to said through holes.

5. A substrate holding apparatus as set forth in claim 3, wherein said outer surface of said chucking plate has one or more raised or elevated portions each having a flat surface; said one or more through holes open at the flat surface; and said membrane is provided with one or more openings through which said elevated portions of said chucking plate are exposed to a substrate held on said outer surface of said membrane.

6. A substrate holding apparatus as set forth in claim 5, wherein said apparatus further comprises a conduit connecting said one or more through holes of said chucking plate to a vacuum source and a conduit connecting said fluid pressure chamber to a pressurized fluid source.

7. A substrate holding apparatus as set forth in claim 1, wherein said fluid pressure chamber is adapted to be selectively connected to a pressurized fluid source or a vacuum source.

8. A substrate holding apparatus as set forth in claim 1, wherein said retainer ring has an annular face having radially inner and outer edges and to be engaged with the polishing surface; and said annular face is provided with one or more grooves extending from said radially outer edge towards said radially inner edge.

9. A substrate holding apparatus as set forth in claim 8, wherein said grooves reach said radially inner edge.

10. A substrate holding apparatus as set forth in claim 8, wherein said grooves end short of said radially inner edge.

11. A substrate holding apparatus as set forth in claim 1, further comprising one or more pushers provided on said substrate holder body and arranged to engage with and urge said membrane support member towards the polishing surface.

12. A substrate holding apparatus for holding a substrate and bringing it into contact with a polishing surface so that the substrate is subjected to polishing by causing relative movement between the substrate and the polishing surface, said apparatus comprising:

a substrate holder body having a substrate holding side facing the polishing surface and holding a substrate on said substrate holding side;

a retainer ring integrally formed with or fixedly secured to said substrate holder body on said substrate holding side thereby forming an inner space defined by said substrate holder body and the retainer ring, the retainer ring being arranged to surround an outer periphery of the substrate to be held by said substrate holding apparatus so that the retainer ring engages with the polishing surface radially outside said substrate as the polishing of the substrate is effected;

a substrate support ring provided in said inner space and arranged to be sealingly engaged with the substrate to be held by said substrate holding apparatus; and a flexible seal member sealingly connected between said substrate support ring and said substrate holder body so that a fluid pressure chamber is defined by said substrate holder body, said flexible seal member and the substrate to be engaged with said substrate support ring, said fluid pressure chamber being arranged to be selectively connected to a pressurized fluid source or a vacuum source.

13. A substrate holding apparatus as set forth in claim 12, further comprising one or more pushers provided on said substrate holder body and arranged to engage with and urge said substrate support ring towards the polishing surface.

14. A substrate polishing apparatus comprising:

a first polishing table having a hard polishing surface; and a substrate holding apparatus for holding a substrate and bringing it into contact with said hard polishing surface, the substrate being subjected to polishing by causing relative movement between the substrate and the polishing surface;

said substrate holding apparatus comprising:

a substrate holder body having a substrate holding side facing the polishing surface and holding a substrate on said substrate holding side; and a membrane provided on said substrate holding side of said substrate holder body, said membrane having opposite surfaces including inside and outside surfaces, the inside surface cooperating with a surface of said substrate holder body to define a fluid pressure chamber to which a fluid pressure is applied, and the outer side surface engaging with the substrate held by said substrate holder body;

wherein said hard polishing surface has a modulus of compression of 19.6 MPa (200 kg/cm$^2$) or more, wherein said hard polishing table is provided with fixed abrasives comprising abrasive particles and a binder binding said abrasive particles and the fixed abrasives provide said hard polishing surface.

15. A substrate polishing apparatus as set forth in claim 14, wherein said substrate holding apparatus further comprises a retainer ring integrally formed with or fixedly secured to said substrate holder body on said substrate holding side, the retainer ring being arranged to surround an outer periphery of the substrate held by said substrate holder body so that the retainer ring engages with the hard polishing surface radially outside said substrate as the polishing of the substrate is effected.

16. A substrate polishing apparatus as set forth in claim 14, said apparatus further including a second polishing table having a soft polishing surface which is softer than said hard polishing surface of said first polishing table and said substrate holder body is arranged such that the substrate holder body holds a substrate, can then bring the substrate into contact with said hard polishing surface to effect a first polishing of the substrate and thereafter bring the substrate into contact with said soft polishing surface to effect a second polishing of the substrate.

17. A substrate polishing apparatus as set forth in claim 16, wherein said soft polishing surface has a smaller modulus of compression than said hard polishing surface.

18. A substrate holding apparatus as set forth in claim 14, wherein said retainer ring has an annular face having radially inner and outer edges and to be engaged with the polishing surface; and said annular surface is provided with one or more grooves extending from said radially outer edge towards said radially inner edge.

19. A substrate holding apparatus as set forth in claim 18, wherein said grooves reach said radially inner edge.

20. A substrate holding apparatus as set forth in claim 18, wherein said grooves end short of said radially inner edge.

21. A substrate polishing apparatus comprising:

a first polishing table having a hard polishing surface; and a substrate holding apparatus for holding a substrate and bringing it into contact with said hard polishing surface, the substrate being subjected to polishing by causing relative movement between the substrate and the polishing surface;

said substrate holding apparatus comprising:

a substrate holder body having a substrate holding side facing the polishing surface;

a substrate support member provided on said substrate holding side of said substrate holder body and arranged to be sealingly engaged with the substrate to be held by said substrate holding apparatus; and a flexible seal member sealingly connected between said substrate support ring and said substrate holder member so that a fluid pressure chamber is defined by said substrate holder body, said flexible seal member and the substrate to be engaged with said substrate support member, said fluid pressure chamber being arranged to be selectively connected to a pressurized fluid source or a vacuum source;

wherein said hard polishing surface has a modulus of compression of 19.6 MPa (200 kg/cm$^2$) or more, wherein said hard polishing table is provided with fixed abrasives comprising abrasive particles and a binder binding said abrasive particles and the fixed abrasives provide said hard polishing surface.

22. A substrate polishing apparatus as set forth in claim 21, wherein said substrate holding apparatus further comprises a retainer ring integrally formed with or fixedly secured to said substrate holder body on said substrate holding side, the retainer ring being arranged to surround an outer periphery of the substrate to be held by said substrate holder body so that the retainer ring engages with the hard polishing surface radially outside the substrate as the polishing of the substrate is effected.

23. A substrate holding apparatus as set forth in claim 22, wherein said retainer ring has an annular face having radially inner and outer edges and to be engaged with the polishing surface; and said annular surface is provided with one or more grooves extending from said radially outer edge towards said radially inner edge.

24. A substrate holding apparatus as set forth in claim 23, wherein said grooves reach said radially inner edge.

25. A substrate holding apparatus as set forth in claim 23, wherein said grooves end short of said radially inner edge.

26. A substrate polishing apparatus as set forth in claim 21, said apparatus further includes a second polishing table having a soft polishing surface which is softer than said hard polishing surface of said first polishing table; and said substrate holder body is arranged such that the substrate holder body can hold a substrate, then bring the substrate into contact with said hard polishing surface to effect a first polishing of the substrate, and thereafter bring the substrate into contact with said soft polishing surface to effect a second polishing of the substrate.

27. A substrate holding apparatus for holding a substrate during a polishing operation of the substrate, said substrate holding apparatus comprising:

a substrate holder body;

a retainer ring integrally formed with or fixedly secured to said substrate holder body; and a flexible membrane having inner and outer surfaces and arranged inside the retainer ring, the outer surface providing a substrate holding surface for holding the substrate, wherein said substrate holder body and said retainer ring cooperate to define an inner space and said membrane is provided in said inner space;

a membrane support member which is provided in said inner space and connected to the outer periphery of said membrane and a flexible seal member connected between said membrane support member and said substrate holder body so that a fluid pressure chamber is defined by said membrane, said membrane support member, said flexible seal member and said substrate holder body;

wherein the substrate to be held by the substrate holding surface is urged against a polishing surface by a fluid pressure supplied into the fluid pressure chamber; and a drive shaft connected to said substrate holder body for rotating said substrate holder body while the substrate is kept urged against the polishing surface, said drive shaft being operable to urge the retainer ring against the polishing surface through said substrate holder body.

28. A substrate holding apparatus as set forth in claim 27, further comprising an air cylinder for applying a force to urge the retainer ring against the polishing surface through said substrate holder body.

29. A substrate holding apparatus for holding a substrate during a polishing operation of the substrate, said substrate holding apparatus comprising:

a substrate holder body holding a substrate; and a retainer ring provided on an outer periphery of said substrate holder body so that the substrate to be held by the substrate holder body is positioned radially inside the retaining ring, said retainer ring having an annular surface to be engaged with a polishing surface radially outside the substrate when the substrate is brought into contact with the polishing surface for polishing of the substrate, the annular surface having radially outer and inner peripheral edges and a groove extending from the radially outer peripheral edge towards the radially inner peripheral edge, wherein the groove ends short of the radially inner peripheral edge.

* * * * *